US009347286B2

(12) United States Patent
Swietlik et al.

(10) Patent No.: US 9,347,286 B2
(45) Date of Patent: May 24, 2016

(54) FLOW STOP VALVE

(75) Inventors: George Swietlik, Lowestoft (GB); Robert Large, Lowestoft (GB); Peter Ryan Morris, Belfast (GB)

(73) Assignee: PILOT DRILLING CONTROL LIMITED, Lowestoft (GB)

( * ) Notice: Subject to any disclaimer, the term of this patent is extended or adjusted under 35 U.S.C. 154(b) by 71 days.

(21) Appl. No.: 13/390,923

(22) PCT Filed: Aug. 18, 2009

(86) PCT No.: PCT/GB2009/002016

§ 371 (c)(1),
(2), (4) Date: May 29, 2012

(87) PCT Pub. No.: WO2011/020979

PCT Pub. Date: Feb. 24, 2011

(65) Prior Publication Data

US 2012/0227982 A1 Sep. 13, 2012

Related U.S. Application Data

(63) Continuation-in-part of application No. 12/867,595, filed as application No. PCT/GB2009/000414 on Feb. 16, 2009, now Pat. No. 8,590,629.

(51) Int. Cl.
*E21B 21/10* (2006.01)
*E21B 21/00* (2006.01)

(52) U.S. Cl.
CPC ..... *E21B 21/10* (2013.01); *E21B 2021/006* (2013.01)

(58) Field of Classification Search
CPC ..... E21B 21/10; E21B 34/14; E21B 34/10; E21B 43/12; E21B 34/06; E21B 21/103; E21B 2021/006
USPC ..... 166/386, 373; 175/232, 243, 316, 318
See application file for complete search history.

(56) References Cited

U.S. PATENT DOCUMENTS 1,447,621 A 3/1923 McDonell et al.
1,735,718 A 11/1929 Attendu (Continued)

FOREIGN PATENT DOCUMENTS

CA 2285767 A1 4/2000
EP 0322170 A2 6/1989

(Continued)

OTHER PUBLICATIONS

For the American Heritage Dictionary definition: bias. (n.d.) The American Heritage® Dictionary of the English Language, Fourth Edition. (2003). Retrieved Dec. 2, 2014 from http://www.thefreedictionary.com/bias.*

(Continued)

*Primary Examiner* — Shane Bomar
*Assistant Examiner* — Wei Wang
(74) *Attorney, Agent, or Firm* — MH2 Technology Law Group, LLP

(57) ABSTRACT

A flow stop valve (200, 300, 400) for placement in a downhole tubular operating in a dual fluid density system, wherein the flow stop valve is arranged such that it is in communication with a pressure difference between one of: fluid outside the downhole tubular and inside the downhole tubular at the flow stop valve; and fluid above and below the flow stop valve inside the downhole tubular, wherein the flow stop valve comprises a first valve element (226', 326', 424) arranged such that the pressure difference acts across at least a portion of the first valve element and that the first valve element is movable between open and closed positions under action of said pressure difference so as to selectively permit flow through the downhole tubular, wherein the first valve element comprises a first passage (212, 312, 446) arranged so as to transmit fluid from a first port (213, 313, 447) in a first side of the first valve element to a second side of the first valve element, the first port being positioned such that it is adjacent to a low pressure flow region (290) when the flow stop valve is in an open position.

27 Claims, 19 Drawing Sheets

(56) References Cited

U.S. PATENT DOCUMENTS

| | | | |
|---|---|---|---|
| 2,214,550 | A | 9/1940 | Edwards |
| 2,644,528 | A | 7/1953 | Ragan |
| 2,647,015 | A | 7/1953 | Berlyn |
| 2,647,016 | A | 7/1953 | Berlyn |
| 2,647,583 | A | 8/1953 | Bernard |
| 2,715,943 | A | 8/1955 | True |
| 2,743,078 | A | 4/1956 | Walter |
| 2,757,741 | A | 8/1956 | O'Reilly |
| 2,796,938 | A | 6/1957 | Lynes et al. |
| 2,909,227 | A | 10/1959 | Bostock |
| 3,077,898 | A | 2/1963 | Raymond |
| 3,090,443 | A | 5/1963 | Bostock |
| 3,382,928 | A | 5/1968 | Phillips et al. |
| 3,385,370 | A | 5/1968 | Knox et al. |
| 3,434,550 | A | 3/1969 | Townsend, Jr. |
| 3,498,674 | A | 3/1970 | Matthews |
| 3,554,281 | A | 1/1971 | Ecuer |
| 3,599,713 | A | 8/1971 | Jenkins |
| 3,601,190 | A | 8/1971 | Mott |
| 3,603,409 | A | 9/1971 | Watkins |
| 3,675,678 | A | 7/1972 | Lamping |
| 3,698,411 | A | 10/1972 | Garrett |
| 3,815,673 | A | 6/1974 | Bruce |
| 3,957,114 | A | 5/1976 | Streich |
| 3,964,556 | A | 6/1976 | Gearhart |
| 3,965,980 | A | 6/1976 | Williamson |
| 3,967,679 | A | 7/1976 | Liljestrand |
| 3,973,586 | A | 8/1976 | Hill |
| 3,973,587 | A | 8/1976 | Cochran |
| 3,987,848 | A | 10/1976 | Canterbury |
| 4,091,881 | A | 5/1978 | Maus |
| 4,099,583 | A | 7/1978 | Maus |
| 4,129,184 | A | 12/1978 | Parker |
| 4,147,221 | A | 4/1979 | Ilfrey |
| 4,270,569 | A | 6/1981 | Reay et al. |
| 4,291,772 | A | 9/1981 | Beynet |
| 4,364,407 | A | 12/1982 | Hilliard |
| 4,391,328 | A | 7/1983 | Aumann |
| 4,624,316 | A | 11/1986 | Baldridge et al. |
| 4,625,755 | A | 12/1986 | Reddoch |
| 4,658,905 | A | 4/1987 | Burge |
| 4,813,495 | A | 3/1989 | Leach |
| 4,895,214 | A | 1/1990 | Schoeffler |
| 4,997,042 | A | 3/1991 | Jordan |
| 5,092,406 | A | 3/1992 | McStravick |
| 5,174,392 | A | 12/1992 | Reinhardt |
| 5,191,939 | A | 3/1993 | Stokley |
| 5,310,012 | A | 5/1994 | Cendre |
| 5,584,343 | A | 12/1996 | Coone |
| 5,682,952 | A | 11/1997 | Stokley |
| 5,918,673 | A | 7/1999 | Hawkins |
| 5,924,490 | A | 7/1999 | Stone |
| 5,971,079 | A | 10/1999 | Mullins |
| 5,979,572 | A | 11/1999 | Boyd |
| 6,125,930 | A | 10/2000 | Moyes |
| 6,216,799 | B1 | 4/2001 | Gonzalez |
| 6,263,981 | B1 | 7/2001 | Gonzalez |
| 6,276,455 | B1 | 8/2001 | Gonzalez |
| 6,325,159 | B1 | 12/2001 | Peterman |
| 6,328,103 | B1 | 12/2001 | Pahmiyer et al. |
| 6,328,109 | B1 | 12/2001 | Pringle |
| 6,386,289 | B1 | 5/2002 | Patel |
| 6,390,190 | B2 | 5/2002 | Mullins |
| 6,401,823 | B1 | 6/2002 | Gonzalez et al. |
| 6,415,862 | B1 | 7/2002 | Mullins |
| 6,435,282 | B1 | 8/2002 | Robison et al. |
| 6,488,092 | B1 | 12/2002 | Schoeffler |
| 6,536,540 | B2 | 3/2003 | De Boer |
| 6,540,020 | B1 | 4/2003 | Falgout, Sr. |
| 6,547,007 | B2 | 4/2003 | Szarka et al. |
| 6,571,876 | B2 | 6/2003 | Szarka |
| 6,585,051 | B2 | 7/2003 | Purkis et al. |
| 6,604,578 | B2 | 8/2003 | Mullins |
| 6,666,273 | B2 | 12/2003 | Laurel |
| 6,675,889 | B1 | 1/2004 | Mullins |
| 6,705,404 | B2 | 3/2004 | Bosley |
| 6,715,542 | B2 | 4/2004 | Mullins |
| 6,722,425 | B2 | 4/2004 | Mullins |
| 6,779,599 | B2 | 8/2004 | Mullins |
| 6,843,331 | B2 | 1/2005 | De Boer |
| 6,926,101 | B2 | 8/2005 | De Boer |
| 6,966,392 | B2 | 11/2005 | De Boer |
| 7,013,980 | B2 | 3/2006 | Purkis et al. |
| 7,090,036 | B2 | 8/2006 | De Boer |
| 7,093,662 | B2 | 8/2006 | De Boer |
| 7,168,493 | B2 | 1/2007 | Eddison |
| 7,299,880 | B2 | 11/2007 | Logiudice |
| 7,373,972 | B2 | 5/2008 | Ocalan |
| 7,584,801 | B2 | 9/2009 | De Boer |
| 7,984,763 | B2 | 7/2011 | Carter et al. |
| 2001/0007284 | A1 | 7/2001 | French |
| 2001/0045290 | A1 | 11/2001 | Pringle et al. |
| 2002/0014338 | A1 | 2/2002 | Purkis et al. |
| 2002/0020558 | A1 | 2/2002 | Gonzalez et al. |
| 2002/0079104 | A1 | 6/2002 | Garcia |
| 2003/0098163 | A1 | 5/2003 | Hebert et al. |
| 2003/0116325 | A1 | 6/2003 | Cook et al. |
| 2004/0084213 | A1 | 5/2004 | De Boer |
| 2004/0129423 | A1 | 7/2004 | Eddison |
| 2006/0011354 | A1 | 1/2006 | Logiudice |
| 2006/0070772 | A1 | 4/2006 | De Boer |
| 2006/0124352 | A1 | 6/2006 | Krueger et al. |
| 2007/0009737 | A1 | 1/2007 | Konno |
| 2007/0012442 | A1 | 1/2007 | Heam |
| 2007/0084607 | A1 | 4/2007 | Wright |
| 2007/0246265 | A1 | 10/2007 | deBoer |
| 2008/0083541 | A1 | 4/2008 | Butterfield et al. |
| 2008/0302569 | A1 | 12/2008 | De Boer |
| 2008/0302570 | A1 | 12/2008 | De Boer |
| 2009/0211814 | A1 | 8/2009 | De Boer |
| 2010/0044054 | A1 | 2/2010 | De Boer |

FOREIGN PATENT DOCUMENTS

| | | | |
|---|---|---|---|
| EP | 0449768 | A1 | 10/1991 |
| GB | 2147641 | A | 5/1985 |
| GB | 2236783 | A | 4/1991 |
| GB | 2245623 | A | 1/1992 |
| GB | 2251446 | A | 7/1992 |
| GB | 2273514 | A | 6/1994 |
| GB | 2314106 | A | 12/1997 |
| GB | 2342935 | A | 4/2000 |
| GB | 2377464 | A | 1/2003 |
| GB | 2378970 | A | 2/2003 |
| GB | 2457497 | | 8/2009 |
| WO | 93/11336 | A1 | 6/1993 |
| WO | 96/30621 | A1 | 10/1996 |
| WO | 99/15758 | A2 | 4/1999 |
| WO | 99/49172 | A1 | 9/1999 |
| WO | 02/075104 | A1 | 9/2002 |
| WO | 2004/033845 | A2 | 4/2004 |
| WO | 2004/044366 | | 5/2004 |
| WO | 2004/083596 | | 9/2004 |
| WO | 2005/062749 | | 7/2005 |
| WO | 2006/000799 | A2 | 1/2006 |
| WO | 2007124097 | | 11/2007 |
| WO | 2007/139581 | | 12/2007 |

OTHER PUBLICATIONS

International Search Report and Written Opinion for PCT/GB2009/002016 mailed Mar. 1, 2012.

PCT/GB2009/000414; International Search Report Published Feb. 11, 2010.

Stanislawek, Mikolaj, Analysis of Alternative Well Control Methods for Dual Density Deepwater Drilling Thesis Statement submitted to Louisiana State University, May 2005, pp. 1-96.

Shelton, John, Experimental Investigation of Drilling Fluid Formulations and Processing Methods for a Riser Dilution Approach to Dual Density Drilling, Thesis Statement Submitted to Louisiana State University, Dec. 2005, pp. 1-109.

Brainard, R.R., A Process Used in Evaluation of Managed-Pressure Drilling Candidates and Probabilistic Cost-Benefit Analysis, OTC 18375, May 1-4, 2006, Houston, Texas, pp. 1-13.

(56) References Cited

OTHER PUBLICATIONS

Kennedy, John, First Dual Gradient Drilling System Set for Field Test, Drilling Contractor, May/Jun. 2001, pp. 1-3.
Rehm, Bill et al., Managed Pressure Drilling, Gulf Publishing Company, Houston, Texas, 2008, pp. 1-30.
Smith, K.L. et al., Subsea Mudlift Drilling JIP: Achieving Dual-Gradient Technology, Deepwater Technology, Gulf Publishing Company, Houston, Texas, Aug. 1999, pp. 21-28.
UK Search Report under Section 17, dated May 14, 2008, UK Application No. GB0802856.5, pp. 1-3.
UK Search Report under Section 17, dated Jul. 29, 2008, UK Application No. GB0802856.5, pp. 1-2.
UK Examination Report under Section 18(3), dated Feb. 9, 2012, UK Application No. GB0802856.5, pp. 1-2.
Non-Final Office Action, dated Feb. 28, 2013, U.S. Appl. No. 13/655,322, filed Oct. 18, 2012, pp. 1-41.
Non-Final Office Action, dated Jan. 16, 2013, U.S. Appl. No. 12/867,595, filed Oct. 29, 2010, pp. 1-11.
Non-Final Office Action dated Jul. 30, 2013, U.S. Appl. No. 13/655,322, filed Oct. 18, 2013, pp. 1-9.
Athina Nickitas-Etienne (Authorized Officer), International Preliminary Report on Patentability and Written Opinion of the International Searching Authority dated Feb. 21, 2012, PCT Application No. PCT/GB2009/002016, filed Aug. 18, 2009, pp. 1-6.

* cited by examiner

FLOW STOP VALVE

This disclosure relates to a flow stop valve which may be positioned in a downhole tubular, and particularly relates to a flow stop valve for use in dual density drilling fluid systems.

BACKGROUND

When drilling a well bore, it is desirable for the pressure of the drilling fluid in the newly drilled well bore, where there is no casing, to be greater than the local pore pressure of the formation to avoid flow from, or collapse of, the well wall. Similarly, the pressure of the drilling fluid should be less than the fracture pressure of the well to avoid well fracture or excessive loss of drilling fluid into the formation. In conventional onshore (or shallow offshore) drilling applications, the density of the drilling fluid is selected to ensure that the pressure of the drilling fluid is between the local formation pore pressure and the fracture pressure limits over a wide range of depths. (The pressure of the drilling fluid largely comprises the hydrostatic pressure of the well bore fluid with an additional component due to the pumping and resultant flow of the fluid.) However, in deep sea drilling applications the pressure of the formation at the seabed SB is substantially the same as the hydrostatic pressure HP of the sea at the seabed and the subsequent rate of pressure increase with depth d is different from that in the sea, as shown in FIG. 1*a* (in which P represents pressure and FM and FC denote formation pressure and fracture pressure respectively). This change in pressure gradient makes it difficult to ensure that the pressure of the drilling fluid is between the formation and fracture pressures over a range of depths, because a single density SD drilling fluid does not exhibit this same step change in the pressure gradient.

To overcome this difficulty, shorter sections of a well are currently drilled before the well wall is secured with a casing. Once a casing section is in place, the density of the drilling fluid may be altered to better suit the pore pressure of the next formation section to be drilled. This process is continued until the desired depth is reached. However, the depths of successive sections are severely limited by the different pressure gradients, as shown by the single density SD curve in FIG. 1*a*, and the time and cost to drill to a certain depth are significantly increased.

In view of these difficulties, dual density DD drilling fluid systems have been proposed (see US2006/0070772 and WO2004/033845 for example). Typically, in these proposed systems, the density of the drilling fluid returning from the wellbore is adjusted at or near the seabed to approximately match the density of the seawater. This is achieved by pumping to the seabed a second fluid with a different density and mixing this fluid with the drilling fluid returning to the surface. FIG. 1*b* shows an example of such a system in which a first density fluid 1 is pumped down a tubular 6 and through a drilling head 8. The first density fluid 1 and any cuttings from the drilling process then flow between the well wall and the tubular. Once this fluid reaches the seabed, it is mixed with a second density fluid 2, which is pumped from the surface SF via pipe 10. This mixing process results in a third density fluid 3, which flows to the surface within a riser 4, but is also outside the tubular 6. The fluids and any drilling cuttings are then separated at the surface and the first and second density fluids are reformed for use in the process.

In alternative proposed systems, a single mixture is pumped down the tubular and when returning to the surface the mixture is separated into its constituent parts at the seabed. These separate components are then returned to the surface via the riser 4 and pipe 10, where the mixture is reformed for use in the process.

With either of the dual density arrangements, the density of the drilling fluid below the seabed is substantially at the same density as the fluid within the tubular and the density of the first and second density fluids may be selected so that the pressure of the drilling fluid outside the tubular and within the exposed well bore is between the formation and fracture pressures.

Such systems are desirable because they recreate the step change in the hydrostatic pressure gradient so that the pressure gradient of the drilling fluid below the seabed may more closely follow the formation and fracture pressures over a wider range of depths (as shown by the dual density DD curve in FIG. 1*a*). Therefore, with a dual density system, greater depths may be drilled before having to case the exposed well bore or adjust the density of the drilling fluid and significant savings may be made. Furthermore, dual density systems potentially allow deeper depths to be reached and hence greater reserves may be exploited.

However, one problem with the proposed dual density systems is that when the flow of drilling fluid stops, there is an inherent hydrostatic pressure imbalance between the fluid in the tubular and the fluid outside the tubular, because the fluid within the tubular is a single density fluid which has a different hydrostatic head to the dual density fluid outside the tubular. There is therefore a tendency for the denser drilling fluid in the tubular to redress this imbalance by displacing the less dense fluid outside the tubular, in the same manner as a U-tube manometer. The same problem also applies when lowering casing sections into the well bore.

UK patent application (GB0802856.5) addresses this issue by providing a flow stop valve positioned in a downhole tubular. (GB0802856.5 is herein incorporated by reference.) The flow stop valve described therein is in a closed position when a pressure difference between fluid outside the downhole tubular and inside the downhole tubular is below a threshold value, thereby preventing flow through the downhole tubular. Furthermore, the flow stop valve is in an open position when the pressure difference between fluid outside the downhole tubular and inside the downhole tubular is above a threshold value, thereby permitting flow through the downhole tubular. The flow stop valve described in GB0802856.5 is therefore opened by a "cracking" pressure provided by pumps and the flow stop valve is otherwise closed to prevent the flow of fluid due to the imbalance in hydrostatic pressures.

However, in some embodiments of such a valve, the valve may chatter when it is opened because once the flow stop valve has opened, the localised pressure above the valve reduces, thereby tending to close the valve again. The present invention therefore seeks to address this issue.

STATEMENTS OF INVENTION

According to a first embodiment there is provided a flow stop valve for placement in a downhole tubular operating in a dual fluid density system, wherein the flow stop valve is arranged such that it is in communication with a pressure difference between: fluid outside the downhole tubular and inside the downhole tubular at the flow stop valve; or fluid above and below the flow stop valve inside the downhole tubular, wherein the flow stop valve comprises a first valve element arranged such that the pressure difference acts across at least a portion of the first valve element and that the first valve element is movable between open and closed positions under action of said pressure difference so as to selectively permit flow through the downhole tubular, wherein the first valve element comprises a first passage arranged so as to transmit fluid from a first port in a first side of the first valve element to a second side of the first valve element, the first port being positioned such that it is adjacent to a low pressure flow region when the flow stop valve is in an at least partially open position. The low pressure flow region may be in fluidic communication with the second side of the first valve element via the first port and the first passage. The flow stop valve may reduce valve chatter and/or may assist in opening the valve. For example, the flow stop valve may assist by opening the valve more quickly or opening the valve more fully than it would have otherwise.

The low pressure flow region may correspond to a high flow velocity region when the flow stop valve is in an open position. The low pressure flow region may correspond to a restriction or narrowing in the cross-sectional flow area.

The flow stop valve may further comprise a second valve element. The first valve element may be movably disposed with respect to the second valve element so as to move between the open and closed positions selectively permitting the flow between the first and second valve elements and thereby through the downhole tubular.

The first port may be arranged such that it is not exposed to fluid in the downhole tubular and below the flow stop valve by the interaction between the first and second valve elements when the flow stop valve is in the closed position. The first port may be exposed to the fluid in the downhole tubular and below the flow stop valve when the flow stop valve is in the open position.

The second valve element may be movably disposed with respect to the first valve element. The second valve element may be biased towards the closed position by virtue of a first resilient member. The second valve element may be substantially spherical and the first valve element may comprise a corresponding valve seat portion which may be adapted to receive the second valve element. The first port may be provided within the valve seat portion or may alternatively be provided below the valve seat portion.

Fluid in the downhole tubular and above the flow stop valve may act on the first side of the first valve element. The first valve element may comprise a shoulder. The shoulder may define a second portion of the second side of the first valve element and the remainder of the second side may define a first portion of the second side of the first valve element.

Fluid outside the downhole tubular may act on the second portion of the second side of the first valve element. Fluid in the downhole tubular and above the flow stop valve may act on the first portion of the second side of the first valve element. Fluid in the downhole tubular and above the flow stop valve may act on the first portion of the second side of the first valve element by virtue of a second passage in the first valve element. The first passage may be arranged so as to transmit fluid from a second port in the first side of the first valve element to the first portion of the second side of the first valve element. The second port may be exposed to fluid in the downhole tubular and above the flow stop valve in the open and closed positions. The first and second passages may join within the first valve element and exit at a common outlet on the first portion of the second side of the first valve element.

The first valve element may be slidably disposed in a housing of the flow stop valve. A vent may be provided in a wall of the housing. The vent may provide a flow path from outside the housing to the second portion of the second side of the first valve element.

The first valve element may be resisted by a second resilient member so as to resist movement of the first valve element under action of the fluid above the flow stop valve.

The flow stop valve may further comprise a third valve element. The third valve element may be disposed so as to limit the movement of the second valve element. The first and second valve members may move together under action of the fluid above the flow stop valve and in the downhole tubular until the second valve member abuts the third valve member. Upon further movement of the first valve member, the first and second valve members may move apart so as to allow fluid to flow between the first and second valve members, thereby permitting flow through the flow stop valve and placing the flow stop valve in an open position. The location of the third valve element with respect to the first and second valve elements may be selectable.

Fluid in the downhole tubular and above the flow stop valve may act on the first side of the first valve element. Fluid in the downhole tubular and below the flow stop valve may act on at least a first portion of the second side of the first valve element. Fluid outside the downhole tubular may act on at least a second portion of the second side of the first valve element.

The flow stop valve may be for use in, for example, drilling and cementing and may be used to control the flow of completion fluids in completion operations. The flow stop valve may be for use in offshore deep sea applications. In such applications, the downhole tubular may extend, at least partially, from the surface to a seabed. The downhole tubular may be, at least partially, located within a riser, the riser extending from the seabed to the surface. The threshold value may be greater than or equal to the pressure difference between the fluid outside the tubular and inside the downhole tubular at the seabed. The first end of the housing may be located above the second end of the housing, the first end of the housing may be connected to a drill string or casing section and the second end of the housing may be connected to another drill string or casing section or a drilling device.

The fluid in the downhole tubular may be at a first density. A fluid at a second density may be combined at the seabed with fluid returning to the surface, so that the resulting mixture between the riser and downhole tubular may be at a third density.

According to another embodiment there is provided a method of controlling flow in a downhole tubular operating in a dual fluid density system, the method comprising: restricting flow through the downhole tubular by closing a flow stop valve when a pressure difference between: fluid outside the downhole tubular and inside the downhole tubular at the flow stop valve; or fluid above and below the flow stop valve inside the downhole tubular, is below a threshold value; and permitting flow through the downhole tubular by opening the flow stop valve when the pressure difference is above a threshold value, wherein the method further comprises transmitting fluid from a first port in a first side of a first valve element to a second side of the first valve element, the first port being positioned such that it is adjacent to a low pressure flow region when the flow stop valve is in an at least partially open position. The low pressure flow region may be in fluidic communication with the second side of the first valve element via the first port and the first passage. The flow stop valve may reduce valve chatter and/or may assist in fully opening the valve.

The method may further comprise: providing a second valve element. The first valve element may be movably disposed with respect to the second valve element so as to move between the open and closed positions. The method may further comprise selectively permitting the flow between the first and second valve elements and thereby through the downhole tubular.

The method may further comprise: arranging the first port such that it may not be in fluidic communication with fluid in the downhole tubular and below the flow stop valve by the interaction between the first and second valve elements when the flow stop valve is in the closed position and the first port may be in fluidic communication with the fluid in the downhole tubular and below the flow stop valve when the flow stop valve is in the open position.

The method may further comprise: permitting the second valve element to be movably disposed with respect to the first valve element. The method may further comprise: biasing the second valve element towards the closed position by virtue of a first resilient member. The method may further comprise: resisting movement of the first valve element under action of the fluid above the flow stop valve with a second resilient member. The method may further comprise: providing a third valve element disposed so as to limit the movement of the second valve element.

The method may further comprise: permitting the first and second valve members to move together under action of the fluid above the flow stop valve and in the downhole tubular until the second valve member abuts the third valve member. The method may further comprise permitting the first and second valve members to move apart upon further movement of the first valve member so as to allow fluid to flow between the first and second valve members, thereby permitting flow through the flow stop valve and placing the flow stop valve in an open position.

The method may further comprise: selecting the location of the third valve element with respect to the first and second valve elements.

The method may further comprise drilling in a dual fluid density system with the flow stop valve disposed in a drill string. Alternatively, the method may further comprise cementing in a dual fluid density system with the flow stop valve disposed adjacent to a casing section. The method may further comprise using the flow stop valve to control the flow in a well in production.

According to another example of the invention, there is provided a flow stop valve, the flow stop valve comprising a first valve element arranged such that a pressure difference acts across at least a portion of the first valve element and that the first valve element is movable between open and closed positions under action of said pressure difference so as to selectively permit flow through the downhole tubular, wherein the first valve element comprises a first passage to transmit fluid from a first port in a first side of the first valve element to a second side of the first valve element, the first port being positioned next to a narrowing in the flow path when the flow stop valve is at least partially in the open position such that a low pressure is transmitted via the first passage to the second side of the first valve element. The flow stop valve may be for use in a downhole tubular operating in a dual fluid density system. The flow stop valve may reduce valve chatter and/or may assist in fully opening the valve.

According to another example of the invention, there is provided a method of operating a flow stop valve, the method comprising: providing a first valve element arranged such that a pressure difference acts across at least a portion of the first valve element and that the first valve element is movable between open and closed positions under action of said pressure difference so as to selectively permit flow through the downhole tubular, transmitting fluid from a first port in a first side of the first valve element to a second side of the first valve element, the first port being positioned next to a narrowing in the flow path when the flow stop valve is at least partially in the open position such that a low pressure is transmitted via the first passage to the second side of the first valve element. The flow stop valve may be for use in a downhole tubular operating in a dual fluid density system. The flow stop valve may reduce valve chatter and/or may assist in fully opening the valve.

According to one example of the invention, there is provided a flow stop valve positioned in a downhole tubular, wherein: the flow stop valve is in a closed position when a pressure difference between fluid outside the downhole tubular and inside the downhole tubular immediately above or at the flow stop valve is below a threshold value, thereby preventing flow through the downhole tubular; and the flow stop valve is in an open position when the pressure difference between fluid outside the downhole tubular and inside the downhole tubular immediately above or at the flow stop valve is above a threshold value, thereby permitting flow through the downhole tubular. The threshold value for the pressure difference between fluid outside the tubular and inside the downhole tubular at the flow stop valve may be variable.

The flow stop valve may comprise: a first biasing element; and a valve; wherein the first biasing element may act on the valve such that the first biasing element may bias the valve towards the closed position; and wherein the pressure difference between fluid outside the downhole tubular and inside the tubular may also act on the valve and may bias the valve towards an open position, such that when the pressure difference exceeds the threshold value the valve may be in the open position and drilling fluid may be permitted to flow through the downhole tubular. The first biasing element may comprise a spring.

The flow stop valve may further comprise a housing, and a hollow tubular section and a sleeve located within the housing, the sleeve may be provided around the hollow tubular section and the sleeve may be located within the housing, the housing may comprise first and second ends and the hollow tubular section may comprise first and second ends, the first end of the hollow tubular section corresponding to the first end of the housing, and the second end of the hollow tubular section corresponding to a second end of the housing.

The hollow tubular section may be slidably engaged within the housing. The sleeve may be slidably engaged about the hollow tubular section.

The hollow tubular section may comprise a port such that the port may be selectively blocked by movement of the hollow tubular section or sleeve, the port may form the valve such that in an open position a flow path may exist from a first end of the housing, through the port and the centre of the tubular section to a second end of the housing.

A third abutment surface may be provided at a first end of the hollow tubular section such that the third abutment surface may limit the travel of the sleeve in the direction toward the first end of the housing. A flange may be provided at the second end of the hollow tubular section. A second abutment surface may be provided at the second end of the housing such that the second abutment surface of the housing may abut the flange of the tubular section limiting the travel of the hollow tubular section in a second direction, the second direction being in a direction towards the second end of the housing.

A first abutment surface may be provided within the housing between the second abutment surface of the housing and the first end of the housing, such that the first abutment surface may abut the flange of the hollow tubular section limiting the travel of the hollow tubular section in a first direction, the first direction being in a direction towards the first end of the housing.

A spacer element of variable dimensions may be provided between the second abutment surface of the housing and the flange of the hollow tubular section, such that the limit on the travel of the hollow tubular section in the second direction may be varied.

A second biasing element may be provided between the second abutment surface of the housing and the flange of the hollow tubular section. The second biasing element may comprise a spring.

The first biasing element may be provided about the hollow tubular section and the first biasing element may be positioned between the first abutment surface of the housing and the sleeve such that it may resist movement of the sleeve in the second direction.

A piston head may be provided at the first end of the hollow tubular section. Fluid pressure at the first end of the housing may act on the piston head and an end of the sleeve facing the first end of the housing. The projected area of the piston head exposed to the fluid at the first end of the housing may be greater than the projected area of the sleeve exposed to the fluid at the first end of the housing.

The sleeve, housing, hollow tubular section and first abutment surface may define a first chamber, such that when the valve is closed, the first chamber may not be in flow communication with the second end of the housing. A passage may be provided through the sleeve, the passage may provide a flow path from the first end of the housing to the first chamber. The projected area of the sleeve facing the fluid in the first end of the housing is greater than the projected area of the sleeve facing the fluid in the first chamber.

A second chamber may be provided between the sleeve and the housing, the chamber may be sealed from flow communication with the first end of the housing and the first chamber. A fourth abutment surface may be provided on an outer surface of the sleeve and a fifth abutment surface may be provided within the housing, such that the fourth and fifth abutment surfaces may define the second chamber and limit the movement of the sleeve in the direction toward the second end of the housing.

A vent may be provided in the housing wall, the vent may provide a flow path between the second chamber and outside the housing of the flow stop valve. The surface of the sleeve defined by the difference between: the projected area of the sleeve facing the fluid in the first end of the housing; and the projected area of the sleeve facing the fluid in the first chamber, may be exposed to the fluid outside the flow stop valve.

A pressure difference between fluid on a first side of the valve and on a second side of the valve may be substantially the same as the pressure difference between fluid outside the downhole tubular and inside the downhole tubular immediately above the flow stop valve.

The flow stop valve may comprise: a third biasing element; and a valve; wherein the third biasing element may act on the valve such that the third biasing element may bias the valve towards the closed position; and wherein the pressure difference between fluid on a first side of the valve and on a second side of the valve may also act on the valve and bias the valve towards an open position, such that when the pressure difference exceeds the threshold value the valve may be in the open position and drilling fluid is permitted to flow through the downhole tubular.

The flow stop valve may further comprise a housing, and a spindle, the spindle may be located within the housing, and may be slidably received in a first receiving portion at a first end of the housing and a second receiving portion at a second end of the housing, the housing may comprise a first abutment surface and the spindle may comprise a second abutment surface, such that the valve may be in a closed position when the second abutment surface of the spindle engages the first abutment surface of the housing.

The spindle may comprise first and second ends, the first end of the spindle corresponding to the first end of the housing, and the second end of the spindle corresponding to a second end of the housing.

The first end of the spindle and the first receiving portion may define a first chamber and the second end of the spindle and the second receiving portion may define a second chamber, the first and second chambers may not be in flow communication with first and second ends of the housing respectively. The third biasing element may comprise a spring provided in the first chamber.

There may be provided a first passage through the spindle from the first end of housing to the second chamber and a second passage through the spindle from the second end of the housing to the first chamber, such that the first chamber may be in flow communication with the second end of the housing and the second chamber may be in flow communication with the first end of the housing.

There may be provided a first passage through the spindle from the first end of housing to the second chamber and a second passage from a hole in a side wall of the housing to the first chamber, such that the first chamber may be in flow communication with fluid outside the downhole tubular and the second chamber may be in flow communication with the first end of the housing.

The projected area of the first end of the spindle facing the fluid in the first chamber may be less than the projected area of the second end of the spindle facing the fluid in the second chamber.

One or more of the spindle, the first receiving portion and the second receiving portion may be manufactured from drillable materials. One or more of the spindle, the first receiving portion and the second receiving portion may be manufactured from a selection of materials including brass and aluminium.

According to another example, there is provided a method for preventing flow in a downhole tubular, wherein when a difference between the pressure of fluid outside the downhole tubular and the pressure of fluid inside the downhole tubular at a flow stop valve is below a threshold value, the flow stop valve is in a closed position, preventing flow through the downhole tubular, and when a difference between the pressure of fluid outside the downhole tubular and the pressure of fluid inside the downhole tubular at the flow stop valve is above a threshold value, the flow stop valve is in an open position, permitting flow through the downhole tubular.

According to another example, there is provided a method for preventing flow in a downhole tubular, wherein when a difference between the pressure of fluid on a first side of a flow stop valve and the pressure of fluid on a second side of the flow stop valve is below a threshold value, the flow stop valve is in a closed position, preventing flow through the downhole tubular, and when a difference between the pressure of fluid on a first side of the flow stop valve and the pressure of fluid on a second side of the flow stop valve is above a threshold value, the flow stop valve is in an open position, permitting flow through the downhole tubular.

The method may comprise drilling in a dual fluid density system with the flow stop valve disposed in a drill string. The method may comprise cementing in a dual fluid density system with the flow stop valve disposed adjacent to a casing section. The flow stop valve may be provided in a shoe of a casing string.

According to another example, there is provided a method for drilling in a dual fluid density system using a valve, the valve preventing flow in a downhole tubular, wherein when a difference between the pressure of fluid outside the downhole tubular and the pressure of fluid inside the downhole tubular at a flow stop valve is below a threshold value, the flow stop valve is in a closed position, preventing flow through the downhole tubular, and when a difference between the pressure of fluid outside the downhole tubular and the pressure of fluid inside the downhole tubular at the flow stop valve is above a threshold value, the flow stop valve is in an open position, permitting flow through the downhole tubular.

According to a further example, there is provided a method for drilling in a dual fluid density system using a valve, the valve preventing flow in a downhole tubular, wherein when a difference between the pressure of fluid on a first side of a flow stop valve and the pressure of fluid on a second side of the flow stop valve is below a threshold value, the flow stop valve is in a closed position, preventing flow through the downhole tubular, and when a difference between the pressure of fluid on a first side of the flow stop valve and the pressure of fluid on a second side of the flow stop valve is above a threshold value, the flow stop valve is in an open position, permitting flow through the downhole tubular.

BRIEF DESCRIPTION OF THE DRAWINGS

For a better understanding of the present disclosure, and to show more clearly how it may be carried into effect, reference will now be made, by way of example, to the following drawings, in which.

DETAILED DESCRIPTION

Figure 1A:
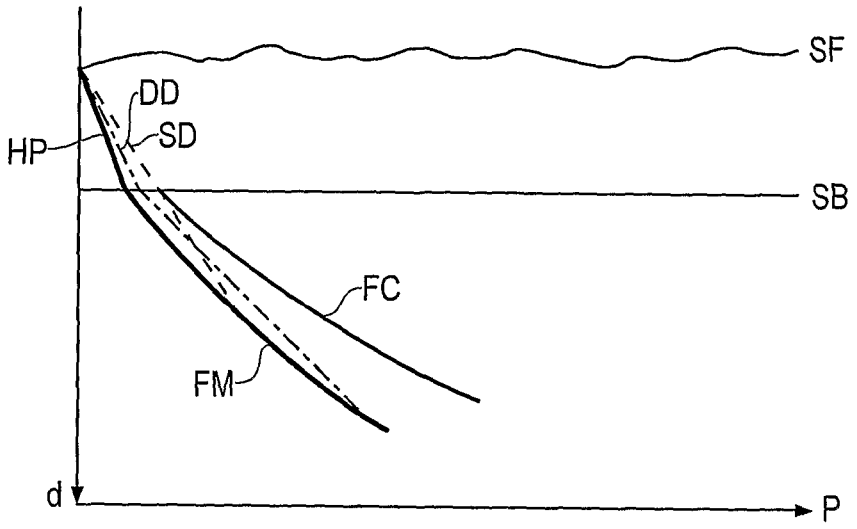
FIG. 1*a* is a graph showing the variation of formation and fracture pressures beneath the seabed.
Figure 1B:
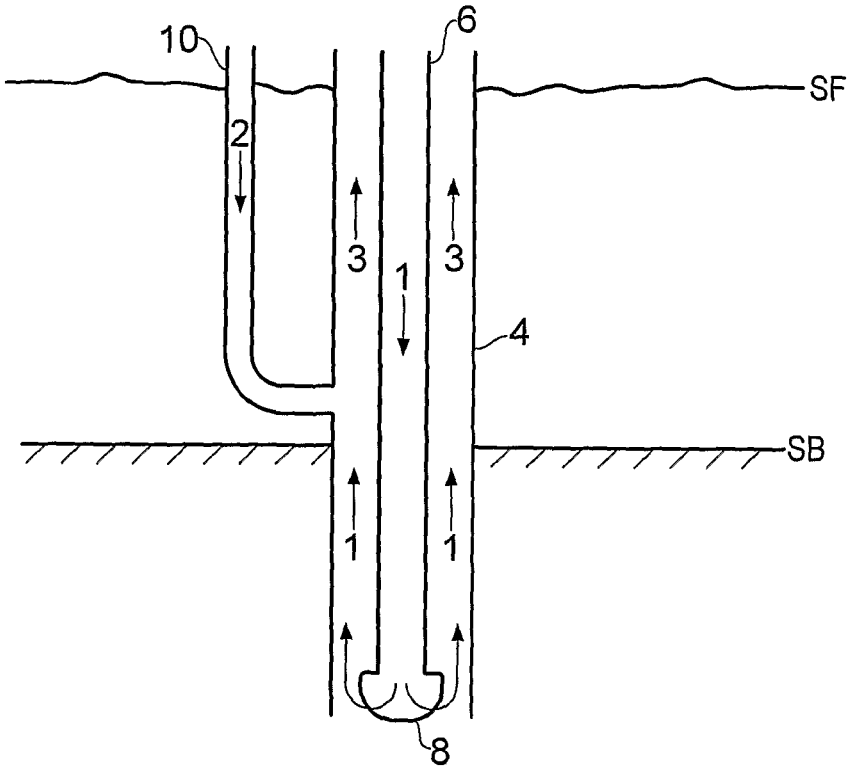
FIG. 1*b* is a schematic diagram showing a proposed arrangement for one example of a dual density drilling system.
Figure 1C:
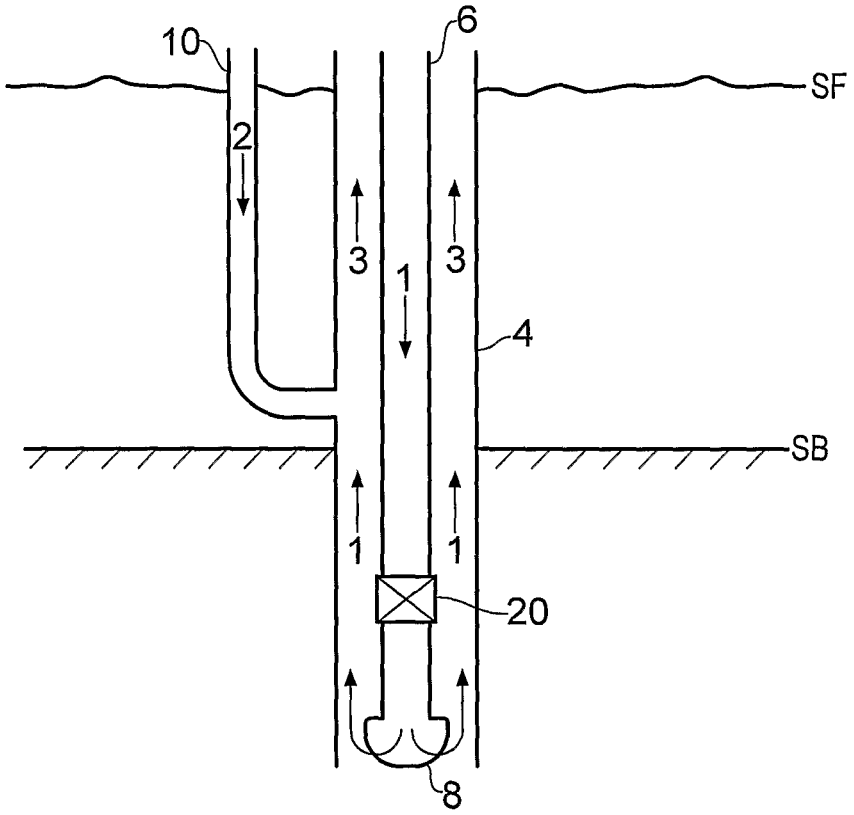
FIG. 1*c* is a schematic diagram showing the positional arrangement of the flow stop valve according to a first comparative example of the disclosure.

With reference to FIG. 1*c*, a flow stop valve 20, according to a first comparative example of the disclosure, is located in a tubular 6 (e.g., a drillstring or casing string) such that, when a drilling head 8 is in position for drilling, the flow stop valve 20 is at any desired point in the tubular, for example, between the seabed SB and the drilling head 8. The illustrated flow stop valve 20 ensures that before the flow of drilling fluid 1 is started, or when it is stopped, the drilling fluid within the tubular 6 is restricted from flow communication with the fluid 1, 3 outside the tubular, thereby preventing uncontrollable flow due to the hydrostatic pressure difference described above.

Figure 2:
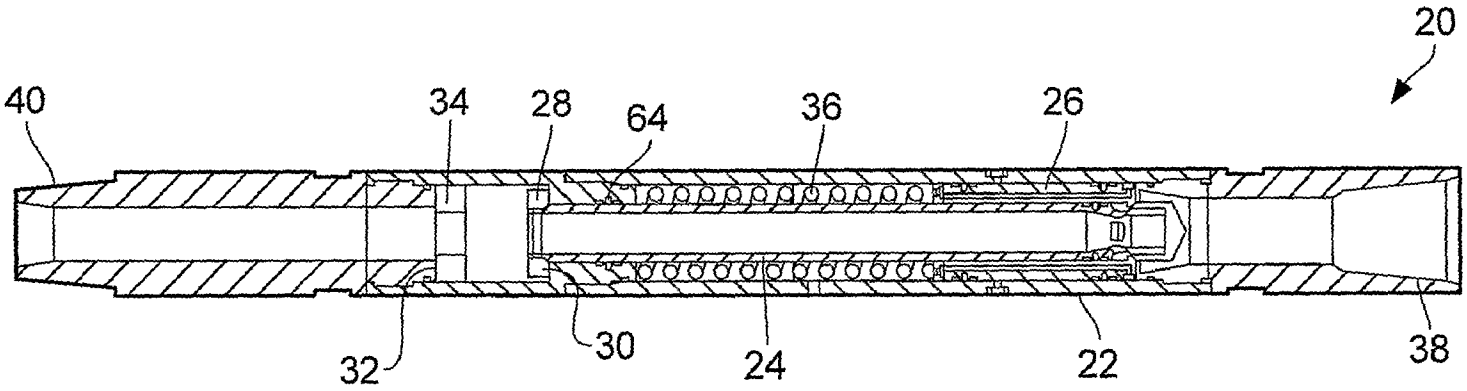
FIG. 2 is a sectional side-view of the flow stop valve according to a first comparative example of the disclosure.

With reference to FIG. 2, the flow stop valve 20, according to the first comparative example of the disclosure, comprises a tubular housing 22 within which there is disposed a hollow tubular section 24. The housing 22 comprises a box 38 at a first end of the housing and a pin 40 at a second end of the housing. (NB, the first end of a component will hereafter refer to the rightmost end as shown in FIGS. 2-4 and accordingly the second end will refer to the leftmost end.) The box 38 and pin 40 allow engagement of the flow stop valve 20 with adjacent sections of a tubular and may comprise conventional box and pin threaded connections, respectively. Although the terms "box" and "pin" are used, any connection to a tubular could be used, for example a socket and plug arrangement. Alternatively, the flow stop valve 20 could be unitary with the tubular 6.

A sleeve 26 is slidably disposed within the housing 22 about a first end of the hollow tubular section 24, such that the sleeve 26 may slide along the hollow tubular section 24 at its first end, and the sleeve 26 may also slide within the housing 22. A flange 28 is provided at a second end of the hollow tubular section 24 and a first abutment shoulder 30 is provided within the housing 22 between the first and second ends of the hollow tubular section 24 such that the hollow tubular section 24 is slidably engaged within the innermost portion of the first abutment shoulder 30 and the motion of the hollow tubular section 24 in a first direction towards the first end of the housing is limited by the abutment of the flange 28 against the first abutment shoulder 30. (NB, the first direction is hereafter a direction towards the rightmost end shown in FIGS. 2-4 and accordingly the second direction is towards the leftmost end.) A second abutment shoulder 32 is provided within the housing 22 and is placed opposite the first abutment shoulder 30, so that the flange 28 is between the first and second abutment shoulders 30, 32. Furthermore, a variable width spacer element 34 may be placed between the second abutment shoulder 32 and the flange 28 and motion of the hollow tubular section 24 in a second direction towards the second end of the housing may be limited by the abutment of the flange 28 against the spacer element 34 and the abutment of the spacer element 34 against the second abutment shoulder 32. The flange 28 and spacer element 34 may both have central openings so that the flow of fluid is permitted from the centre of the hollow tubular section 24 to the second end of the flow stop valve 20.

The flow stop valve 20, according to the first comparative example of the disclosure, may also be provided with a spring 36, which is located between the first abutment shoulder 30 and the sleeve 26. The illustrated spring 36 may resist motion of the sleeve 26 in the second direction.

Figure 3A:
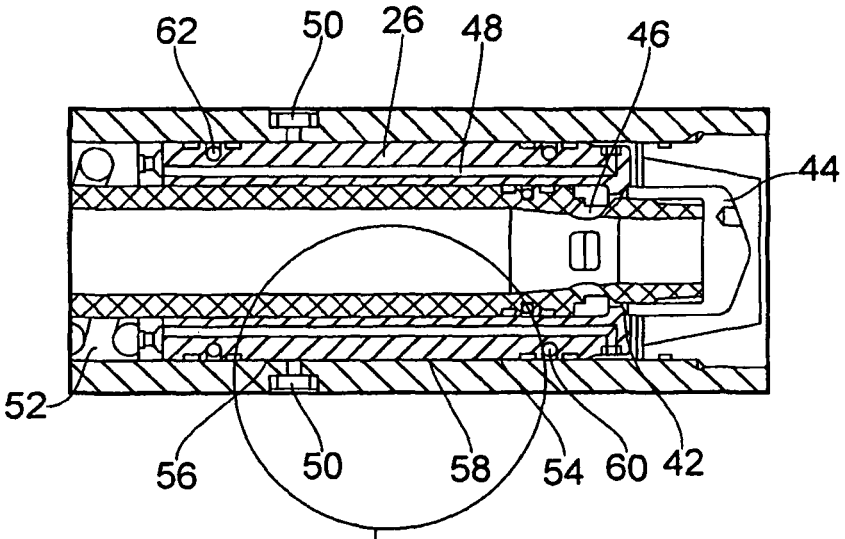
FIGS. 3*a* and 3*b* are sectional side-views showing the valve sleeve according to a first comparative example of the disclosure with FIG. 3*b* being an enlarged view of FIG. 3*a;*
Figure 3B:
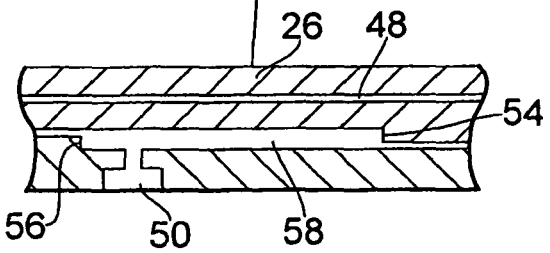

With reference to FIGS. 3*a* and 3*b*, the hollow tubular section 24, according to the first comparative example of the disclosure, further comprises a cone shaped piston head 44 disposed at the first end of the hollow tubular section 24. The piston head 44 may be provided with a third abutment shoulder 42, which abuts a first end of the sleeve 26 thereby limiting motion of the sleeve 26 relative to the hollow tubular section 24 in the first direction. The piston head 44 may be any desired shape. For example, it may be cone shaped as in the illustrated example. The hollow tubular section 24 may further comprise one or more ports 46, which may be provided in a side-wall of the hollow tubular section 24 at the first end of the hollow tubular section 24. The ports 46 may permit flow from the first end of the flow stop valve 20 into the centre of the hollow tubular section 24, through the openings in the flange 28 and spacer element 34 and subsequently to the second end of the flow stop valve 20. However, when the sleeve 26 abuts the third abutment shoulder 42 of the piston head 44, the sleeve 26 may block the ports 46 and hence prevents flow from the first end of the flow stop valve 20 to the centre of the hollow tubular section 24.

The sleeve 26 may further comprise a sleeve vent 48 which provides a flow passage from the first end of the sleeve 26 to the second end of the sleeve 26 and thence to a first chamber 52, which contains the spring 36 and is defined by the housing 22, the hollow tubular section 24, the first abutment shoulder 30 and the second end of the sleeve 26. The sleeve vent 48 may thus ensure that the pressures acting on the first and second ends of the sleeve 26 are equal. However, the projected area of the first end of the sleeve 26 may be greater than the projected area of the second end of the sleeve 26 so that the force due to the pressure acting on the first end of the sleeve 26 is greater than the force due to the pressure acting on the second end of the sleeve 26. This area difference may be achieved by virtue of a fourth abutment shoulder 54 in the sleeve 26 and a corresponding fifth abutment shoulder 56 in the housing 22. The fourth abutment shoulder 54 may be arranged so that the diameter of the sleeve 26 at its first end is greater than that at its second end and furthermore, motion of the sleeve 26 in the second direction may be limited when the fourth and fifth abutment shoulders 54, 56 abut. The fourth and fifth abutment shoulders 54, 56, together with the sleeve 26 and housing 22 may define a second chamber 58 and a housing vent 50 may be provided in the side-wall of the housing 22 so that the second chamber 58 may be in flow communication with the fluid outside the flow stop valve 20. The net force acting on the sleeve 26 is therefore the product of (1) the difference between the pressure outside the flow stop valve 20 and at the first end of the flow stop valve 20, and (2) the area difference between the first and second ends of the sleeve.

Seals 60, 62 may be provided at the first and second ends of the sleeve 26 respectively so that the second chamber 58 may be sealed from the first end of the flow stop valve 20 and the first chamber 52 respectively. Furthermore, seals 64 may be provided on the innermost portion of the first abutment shoulder 30 so that the first chamber 52 may be sealed from the second end of the flow stop valve 20.

Figure 4A:
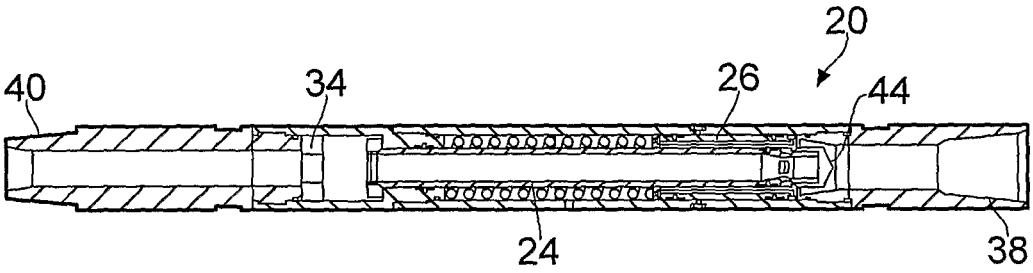
FIGS. 4*a*, 4*b* and 4*c* are sectional side-views of the flow stop valve in the closed, preloaded and open positions according to a first comparative example of the disclosure.
Figure 4B:
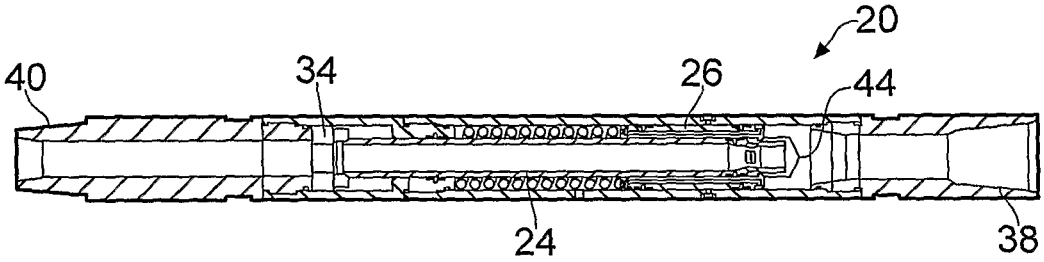
Figure 4C:
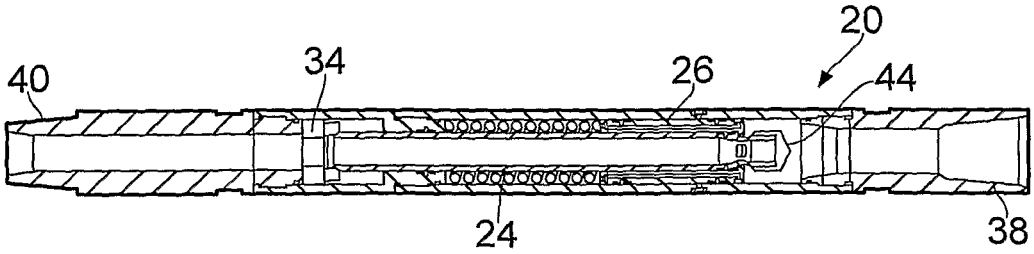

With reference to FIGS. 4*a*, 4*b* and 4*c*, operation of the flow stop valve 20, according to the first comparative example of the disclosure, will now be explained. The flow stop valve 20 may be located in a tubular with the first end above the second end and the flow stop valve 20 may be connected to adjacent tubular sections via the box 38 and pin 40. Prior to lowering of the tubular into the wellbore (e.g., the riser of an offshore drilling rig), there may be a small preload in the spring 36 so that the sleeve 26 abuts the third abutment shoulder 42 of the piston head 44 and the ports 46 are closed, as shown in FIG. 4*a*. In this position no drilling fluid may pass through the flow stop valve 20.

As the tubular and hence flow stop valve 20 is lowered into the riser, the hydrostatic pressures inside and outside the tubular and flow stop valve 20 begin to rise. With one example of a dual density drilling fluid system, the density of the fluid within the tubular may be higher than the density of the fluid outside the tubular, and the hydrostatic pressures within the tubular (and hence those acting on the piston head 44 and first and second ends of the sleeve 26) therefore increase at a greater rate than the pressures outside the tubular. The difference between the pressures inside and outside the tubular may increase until the seabed is reached, beyond which point the fluids inside and outside the tubular may have the same density and the pressures inside and outside the tubular may increase at the same rate.

Before the flow stop valve 20 reaches the seabed, the increasing pressure difference between the inside and outside of the tubular also acts on the hollow tubular section 24 because the top (first) end of the flow stop valve 20 is not in flow communication with the bottom (second) end of the flow stop valve 20. This pressure difference acts on the projected area of the piston head 44, which in one comparative example may have the same outer diameter as the hollow tubular section 24. The same pressure difference may also act on the difference in areas between the first and second ends of the sleeve, however, this area difference may be smaller than the projected area of the piston head 44. Therefore, as the flow stop valve 20 is lowered into the riser, the force acting on the hollow tubular section 24 may be greater than the force acting on the sleeve 26. Once the forces acting on the hollow tubular section 24 and sleeve 26 overcome the small preload in the spring 36, the hollow tubular section 24 may be moved downwards (i.e., in the second direction) and because the force on the piston head 44 may be greater than that on the sleeve 26, the sleeve 26 remains abutted against the third abutment shoulder 42 of the piston head 44. This movement of the hollow tubular section 24 may continue until the flange 28 abuts the spacer element 34, at which point the flow stop valve 20 may be fully preloaded, as shown in FIG. 4*b*. The pressure difference at which this occurs, and the resulting force in the spring, may be varied by changing the thickness of the spacer element 34. With a larger spacer element 34 the hollow tubular section 24 may travel a shorter distance before the flow stop valve 20 is preloaded and may result in a smaller spring force. The opposite applies for a smaller spacer element 34. (The size of the spacer element 34 may be selected before installing the flow stop valve 20 into the tubular.)

When the hollow tubular section 24 cannot move any further the flow stop valve 20 is in a fully preloaded state. However, in the fully preloaded state, the force acting on the sleeve 26 is not yet sufficient to overcome the spring force, because the pressure difference acting on the sleeve 26 acts on a much smaller area. The sleeve 26 may therefore remain in contact with the third abutment shoulder 42 and the ports 46 may stay closed. The flow stop valve 20 may be lowered further for the pressure difference acting on the sleeve 26 to increase. The spacer element 34 thickness may be selected so that once the flow stop valve 20 reaches the seabed, the pressure difference and hence pressure forces acting on the sleeve 26 at this depth are just less than the spring force in the fully preloaded state. At the seabed the pressure forces are therefore not sufficient to move the sleeve 26, but a further increase, which may be a small increase, in the pressure upstream of the flow stop valve may be sufficient to overcome the spring force in the fully preloaded state and move the sleeve 26. However, as the flow stop valve 20 is lowered below the seabed, the pressure difference may not increase any more (for the reasons explained above) and hence the ports 46 will remain closed. Once the tubular is in place and the flow of drilling fluid is desired, an additional "cracking" pressure may be applied by the drilling fluid pumps, which may be sufficient to overcome the fully preloaded spring force, thereby moving the sleeve 26 downwards (in the second direction) and permitting flow through the ports 46 and the flow stop valve 20.

By preventing flow until the drilling fluid pumps provide the "cracking" pressure, the flow stop valve 20 described above may solve the aforementioned problem of the fluid in the tubular displacing the fluid outside the tubular due to the density differences and resulting hydrostatic pressure imbalances.

In an alternative example, the flange 28 may be replaced with a tightening nut disposed about the second end of the hollow tubular section 24, so that the initial length of the spring 36, and hence the fully preloaded spring force, may be varied at the surface. With such an arrangement, the spacer element 34 may be removed.

Figure 5:
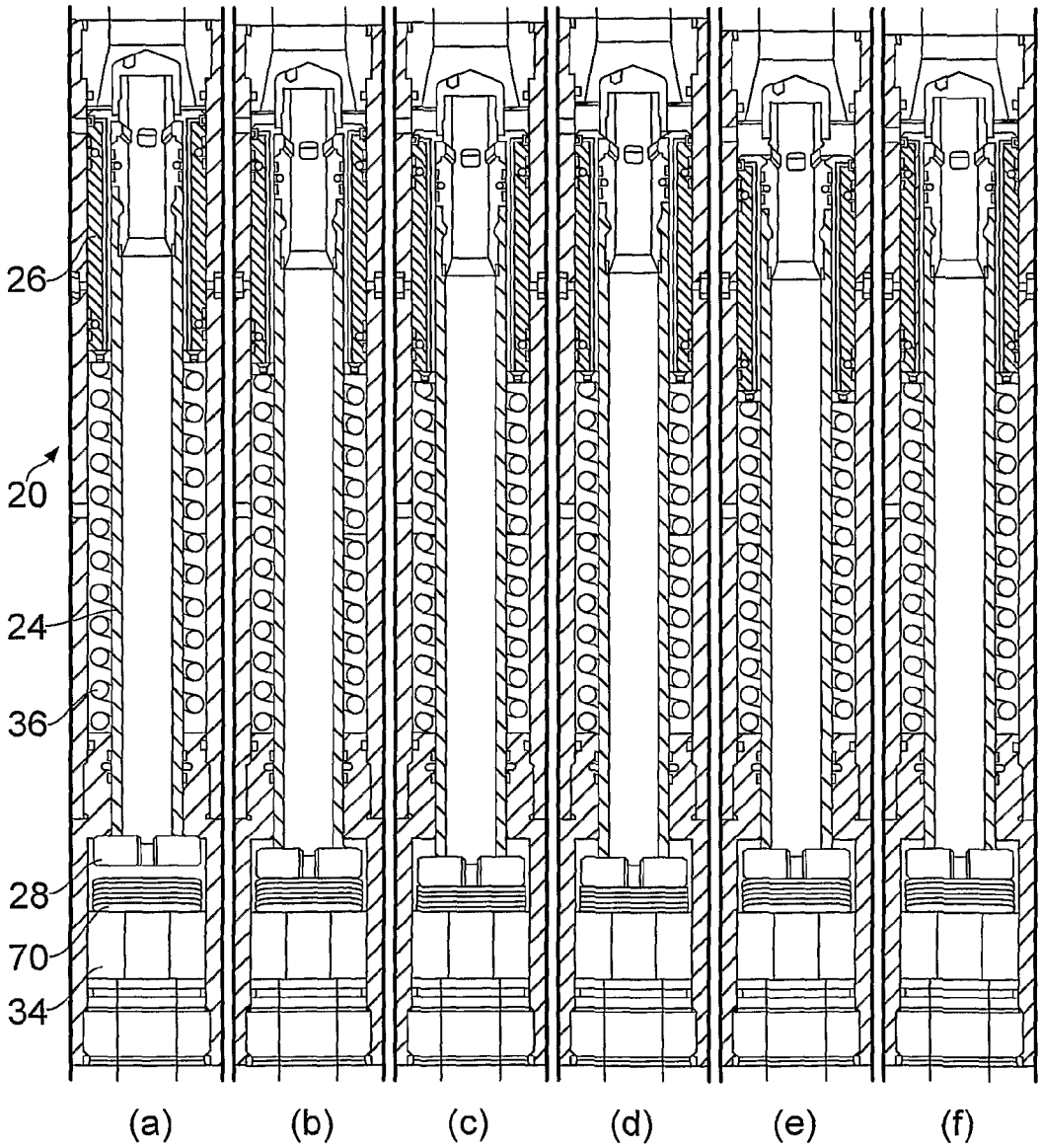
FIGS. 5*a*, 5*b*, 5*c*, 5*d*, 5*e* and 5*f* are sectional side-views of the flow stop valve according to a second comparative example of the disclosure.

With reference to FIGS. 5*a-f*, a flow stop valve 20, according to a second comparative example of the disclosure, may further comprise a second spring 70 disposed between the flange 28 and spacer element 34. The second spring 70 may fit within the housing 22 and the second spring 70 may be sized to allow the passage of fluid through the flow stop valve 20. For example, the inner diameter of the second spring 70 may be greater than, or equal to, the inner diameter of the hollow tubular section 24 and/or the spacer element 34. In an uncompressed state, the second spring 70 may not contact the flange 28 when the hollow tubular section 24 is in its raised position (as shown in FIG. 5*a*). Alternatively, when in an uncompressed state the second spring 70 may at all times contact both the flange 28 and spacer element 34, Operation of the second comparative example will now be explained with reference to FIGS. 5*a-f*, which show the various stages of the flow stop valve. FIG. 5*a* shows the flow stop valve 20 at the surface prior to lowering into the hole with the sleeve 26 and hollow tubular section 24 in their first-most directions. FIG. 5*b* shows the flow stop valve 20 as it is lowered into the hole and the higher pressure acting at the first end of the flow stop valve 20 causes the spring 36 to compress. When the flow stop valve 20 is lowered further into the hole, for example, as shown in FIG. 5*c*, the pressure differential acting across the sleeve 26 and hollow tubular section 24 increases. The spring 36 may be further compressed by the hollow tubular section 24 being forced in the second direction and, as the flange 28 comes into contact with the second spring 70, the second spring 70 may also be compressed. The pressure differential acting across the sleeve 26 and hollow tubular section 24 reaches a maximum value when the flow stop valve reaches the seabed and as the flow stop valve is lowered further below the sea bed the pressure differential remains substantially constant at this maximum value. This is because the hydrostatic pressure inside and outside the downhole tubular increase at the same rate due to the fluid densities below the sea bed being the same inside and outside the downhole tubular. Therefore, an additional "cracking" pressure is required to open the flow stop valve, and this additional cracking pressure may be provided by a dynamic pressure caused by the flow of fluid in the downhole tubular.

FIG. 5*d* shows the flow stop valve 20 at a depth below the seabed. Once the "cracking" pressure has been applied (for example by pumping fluid down the downhole tubular) the sleeve 26 may begin to move in the second direction and the ports 46 may be opened permitting flow through the flow stop valve 20. As the fluid begins to flow, the pressure difference acting across the hollow tubular section 24 may be reduced. The downward force acting on the hollow tubular section 24 may therefore also be reduced and the second spring 36 may then be able to force the hollow tubular section 24 upwards, i.e. in the first direction, as shown in FIG. 5*e*. Movement of the hollow tubular section 24 in the first direction may also cause the ports 46 to open more quickly. This may serve to further reduce the pressure drop across the flow stop valve 20, which may in turn further raise the hollow tubular section 24.

As shown in FIG. 5*f*, when the dynamic pressure upstream of the flow stop valve is reduced (for example by stopping the pumping of drilling fluid), the sleeve 26 returns to the first end of the hollow tubular section 24 closing the ports 46 and hence the flow stop valve 20.

The second spring 70 may be any form of biasing element and for example may be a coiled spring, disc spring, rubber spring or any other element exhibiting resilient properties. The combined thickness of the spacer element 34 and the second spring 70 in a compressed state may determine the preloading in the spring 36 and hence the "cracking" pressure to open the flow stop valve 20. In one example, to obtain an appropriate cracking pressure for the desired depth, the thickness of the spacer element 34 and/or second spring 70 in a compressed state may be selected before installing the flow stop valve 20 into the tubular.

In an alternative to the second comparative example, a second spring 70 may completely replace the spacer element 34, e.g., so that the second spring 70 may be located between the second abutment shoulder 32 and the flange 28. In such a example the preloading in the spring 36 may be determined by the length of the second spring 70 in a compressed state.

A flow stop valve according to a third comparative example of the disclosure relates to the lowering of a tubular and may in particular relate to the lowering of a casing section into a newly drilled and exposed portion of a well bore. The flow stop valve is located in a tubular being lowered into a well bore, such that, when a tubular is in position for sealing against the well wall, the flow stop valve is at any point in the tubular between the seabed and the bottom of the tubular. In particular, the flow stop valve 120 may be located at the bottom of a casing string, for example, at a casing shoe. The flow stop valve may ensure that before the flow of fluid, e.g., a cement slurry, is started, or when it is stopped, the fluid within the tubular is not in flow communication with the fluid outside the tubular, thereby preventing the flow due to the hydrostatic pressure difference described above. (The aforementioned problem of the hydrostatic pressure imbalance applies equally to cementing operations as the density of a cement slurry may be higher than a drilling fluid.)

Figure 6:
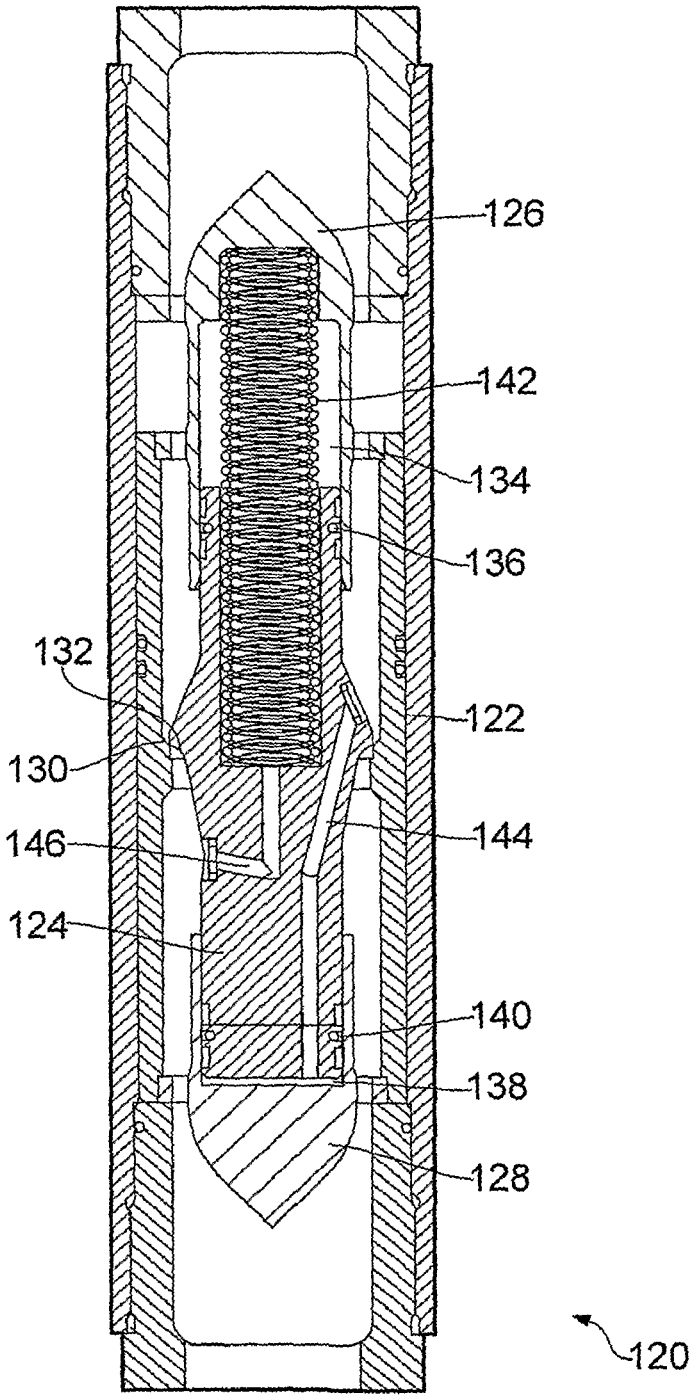
FIG. 6 is a sectional side-view of the flow stop valve according to a third comparative example of the disclosure.

With reference to FIG. 6, the flow stop valve 120, according to the third comparative example of the disclosure, may comprise a housing 122 and a spindle 124. The spindle 124 may be slidably received in both a first receiving portion 126 and a second receiving portion 128. The first receiving portion 126 may be attached to a first end of the housing 122 and the second receiving portion 128 may be attached to a second end of the housing 122. (NB, the first end of a component will hereafter refer to the topmost end as shown in FIG. 6 and accordingly the second end will refer to the bottommost end of the third comparative example) The attachments between the housing 122 and the first and second receiving portions 126, 128 may be arranged such that a flow is permitted between the housing 122 and the first receiving portion 126 and the housing 122 and the second receiving portion 128.

The housing further may comprise a first annular abutment surface 130, which is located on the inner sidewall of the housing and between the first and second receiving portions 126, 128. The spindle 124 may also comprise a second annular abutment surface 132 and the second annular abutment surface may be provided between first and second ends of the spindle 124. The arrangement of the first and second annular abutment surfaces 130, 132 may permit motion of the spindle 124 in a first direction but may limit motion in a second direction. (NB, the first direction is hereafter a direction towards the topmost end shown in FIG. 6 and accordingly the second direction is towards the bottommost end of the third comparative example.) Furthermore, the second annular abutment surface 132 may be shaped for engagement with the first annular abutment surface 130, such that when the first and second annular abutment surfaces abut, flow from first end of the flow stop valve 120 to the second end of the flow stop valve 120 may be prevented.

The first receiving portion 126 and first end of the spindle 124 together may define a first chamber 134. Seals 136 may be provided about the first end of the spindle 124 to ensure that the first chamber 134 is not in flow communication with the first end of the flow stop valve 120. Similarly, the second receiving portion 128 and the second end of the spindle 124 together define a second chamber 138. Seals 140 may be provided about the second end of the spindle 124 to ensure that the second chamber 138 is not in flow communication with the second end of the flow stop valve 120.

The projected area of the first and second ends of the spindle 124 in the first and second chambers 134, 138 may be equal and the projected area of the second annular abutment surface 132 may be less than the projected area of the first and second ends of the spindle 124.

A spring 142 may be provided in the first chamber 134 with a first end of the spring 142 in contact with the first receiving portion 126 and a second end of the spring 142 in contact with the spindle 124. The spring 142 may bias the spindle 124 in the second direction such that the first and second abutment surfaces 130, 132 abut. A spacer element (not shown) may be provided in the first chamber 134 between the spring 142 and spindle 124 or the spring 124 and first receiving portion 126. The spacer element may act to reduce the initial length of the spring 142 and hence the pretension in the spring.

The spindle 124 may also be provided with a first passage 144 and a second passage 146. The first passage 144 may provide a flow path from the first end of the flow stop valve 120 to the second chamber 138, whilst the second passage 146 may provide a flow path from the second end of the slow stop valve 120 to the first chamber 134. However, when the first annular abutment surface 130 abuts the second annular abutment surface 132, the first passage 144 may not be in flow communication with the second passage 146.

The flow stop valve 120 may be manufactured from Aluminium (or any other readily drillable material, for example brass) to allow the flow stop valve 120 to be drilled out once the cementing operation is complete. In addition, the spring 142 may be one or more Belleville washers or a wave spring; e.g., to allow the use of a larger spring section whilst still keeping it drillable. To assist in the drilling operation the flow stop valve 120 may be located eccentrically in an outer casing to allow it to be easily drilled out by a conventional drill bit. Furthermore, the flow stop valve 120 may be shaped to assist the fluid flows as much as possible and so reduce the wear of the flow stop valve 120 through erosion.

In operation the pressure from the first and second ends of the flow stop valve 120 acts on the second and first chambers 138, 134 respectively via the first and second passages 144, 146 respectively. The projected area of the first and second ends of the spindle 124 in the first and second chambers 134, 138 may be equal, but because the pressure in the first end of the flow stop valve 120 is higher than the pressure in the second end of the flow stop valve 120 (for example, when used with the dual density system explained above) the forces acting in the second chamber 138 are higher than those in the first chamber 134. Furthermore, as the projected area of the second annular abutment surface 132 may be less than the projected area of the first and second ends of the spindle 124, the net effect of the pressure forces is to move the spindle 124 in a first direction. However, the spring 142 may act on the spindle 124 to oppose this force and keep the flow stop valve 120 in a closed position (i.e. with the first and second annular abutment surfaces 130, 132 in engagement). The spring 142 does may not support the complete pressure force, because the area in the first and second chambers 134, 138 may be greater than that around the centre of the spindle 124 and the net force acting on the first and second chambers 134, 138 is in the opposite direction to the force acting on the second annular abutment surface 132.

The opening of the flow stop valve 120 may occur when the pressure differential acting over the spindle 124 reaches the desired "cracking" pressure. At this pressure, the net force acting on the spindle 124 is enough to cause the spindle 124 to move in a first direction, thereby allowing cementing fluid to flow. The pressure difference at which this occurs may be varied by selecting an appropriate spacer element to adjust the pretension in the spring.

However, once fluid starts to flow through the flow stop valve 120, the pressure difference acting across the spindle 124 may diminish, although a pressure difference may remain due to pressure losses caused by the flow of fluid through the valve. Therefore, in the absence of the pressure differences present when there is no flow, the spring 142 may act to close the valve. However, as the valve closes the pressure differences may again act on the spindle 124, thereby causing it to re-open. This process may repeat itself and the spindle 124 may "chatter" during use. The oscillation between the open and closed positions assists in maintaining the flow of cementing fluid and these dynamic effects may help to prevent blockage between the first and second annular abutment surfaces 130, 132.

Figure 7:
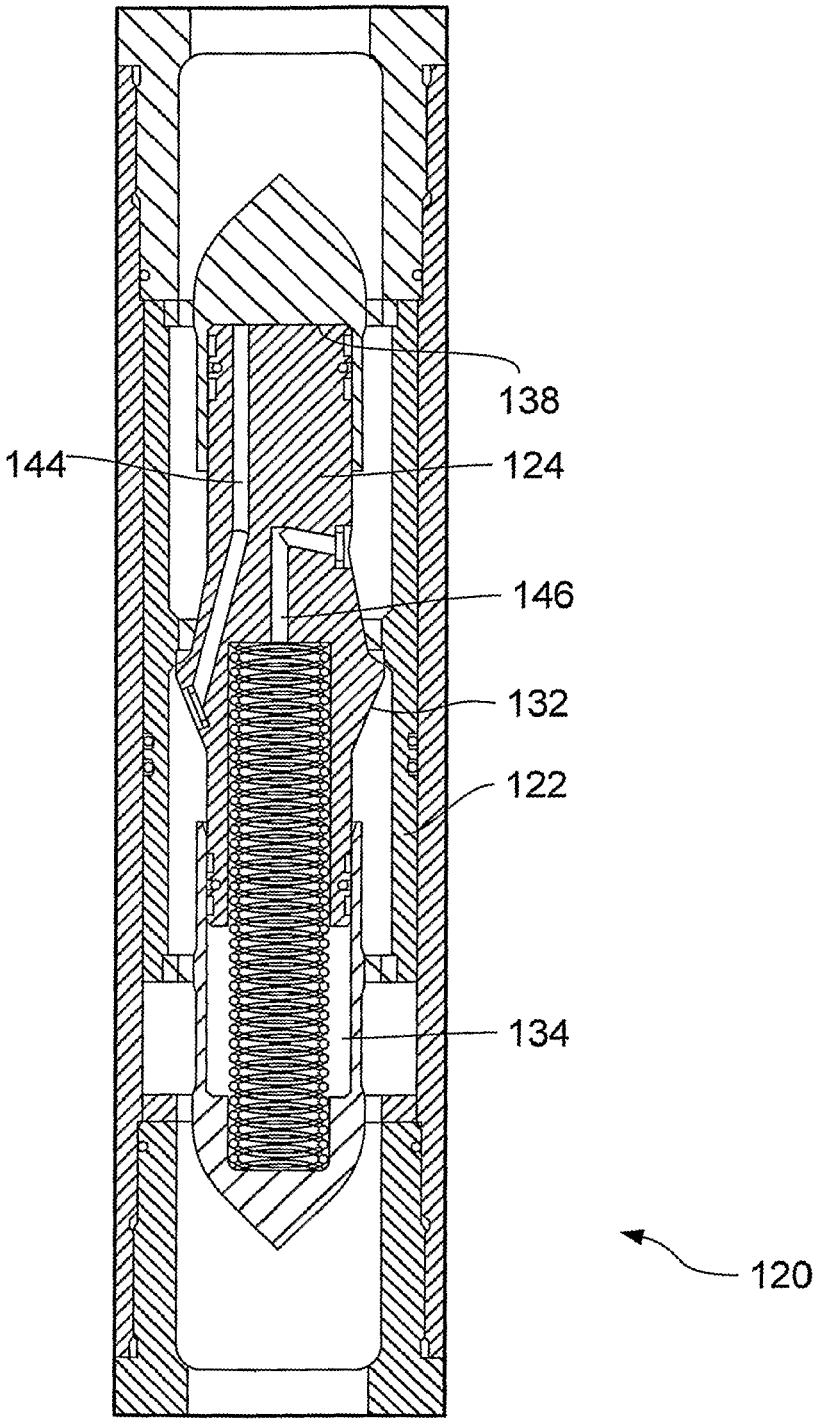
FIG. 7 is a sectional side-view of the flow stop valve according to a fourth comparative example of the disclosure.

With reference to FIG. 7, the flow stop valve 120, according to a fourth comparative example of the disclosure is substantially similar to the third comparative example of the disclosure, except that the flow stop valve 120 may be orientated in the opposite direction (i.e. the first end of the housing 122 is at the bottommost end and the second end of the housing 122 is at the topmost end). In addition, the fourth comparative example may differ from the third comparative example in that the projected area of the second annular abutment surface 132 may be greater than the projected area of the first and second ends of the spindle 124. Aside from these differences the fourth comparative example is otherwise the same as the third comparative example and like parts have the same name and reference numeral.

During operation of the fourth comparative example, higher pressure fluid from above the flow stop valve 120 may act on the first chamber 134 by virtue of the second passage 146, and lower pressure fluid may act on the second chamber 138 by virtue of first passage 144. The pressure forces on the first and second chambers 134, 138, together with the spring force, may act to close the flow stop valve 120 (i.e. with the first and second annular abutment surfaces 130, 132 in engagement). However, as the projected area of the first annular abutment surface 130 may be greater than the projected area of the first and second ends of the spindle 124, the net effect of the pressure forces is to move the spindle 124 into an open position. Therefore, once the pressure forces have reached a particular threshold sufficient to overcome the spring force, the flow stop valve 120 may be open.

In alternative examples, the first and second ends of the spindle 124 may have different projected areas. For example, increasing the projected area of the first end of the spindle 124 for the third comparative example relative to the second end of the spindle 124, may further bias the valve into a closed position and may hence increase the "cracking" pressure to open the valve. Other modifications to the projected areas may be made in order to change the bias of the valve, as would be understood by one skilled in the art.

Figure 8:
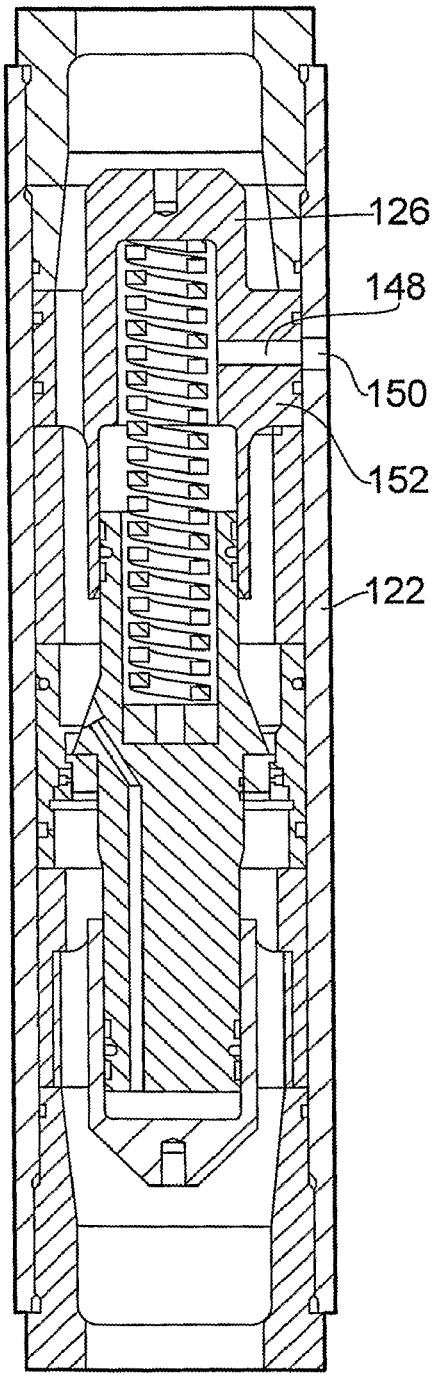
FIG. 8 is a sectional side view of the flow stop valve according to a fifth comparative example of the disclosure.

With reference to FIG. 8, the flow stop valve 120, according to a fifth comparative example of the disclosure is substantially similar to the third comparative example of the disclosure, except that the second passage 146 of the spindle 124 has been omitted. Instead, the first receiving portion 126 may be provided with a third passage 148 which provides a flow passage from the first receiving portion 126 to the outside of the flow stop valve 120. There may be a corresponding hole 150 in the housing 122. The third passage 148 may be provided within a portion 152 of the first receiving portion 126 which extends to meet the inner surface of the housing 122. However, a flow passage may still be maintained around the first receiving portion 126 such that a fluid may flow from the first end of the flow stop valve 120 to the second end of the flow stop valve 120. Aside from these differences, the fifth comparative example is otherwise the same as the third comparative example and like parts have the same name and reference numeral.

The fifth comparative example works in the same way as the third comparative example because once the flow stop valve is below the seabed the fluid just below the flow stop valve and inside the downhole tubular has the same density as the fluid just below the flow stop valve and outside the downhole tubular (see FIG. 1*b*). Therefore, the hydrostatic pressure of the fluid outside the flow stop valve may be the same as that inside the downhole tubular just below the flow stop valve. (By contrast, the pressure of the fluid above the flow stop valve 120 may be different from that outside the flow stop valve 120 because the density of the fluid above the flow stop valve and inside the downhole tubular is different from the density of the fluid above the flow stop valve and outside the downhole tubular, as shown in FIG. 1*b*.) It therefore follows that, before the flow stop valve 120 opens, the pressure difference between fluid on the first and second sides of the valve may be substantially the same as the pressure difference between fluid inside and outside the valve at a point just above the valve (neglecting the hydrostatic pressure difference between above and below the valve outside of the valve as this may be relatively small in comparison to the depths involved). Thus, the fifth comparative example, which only differs from the third comparative example by tapping the pressure from outside the flow stop valve instead of below the flow stop valve for the first receiving portion 126, may work in the same way as the third comparative example.

Figure 9:
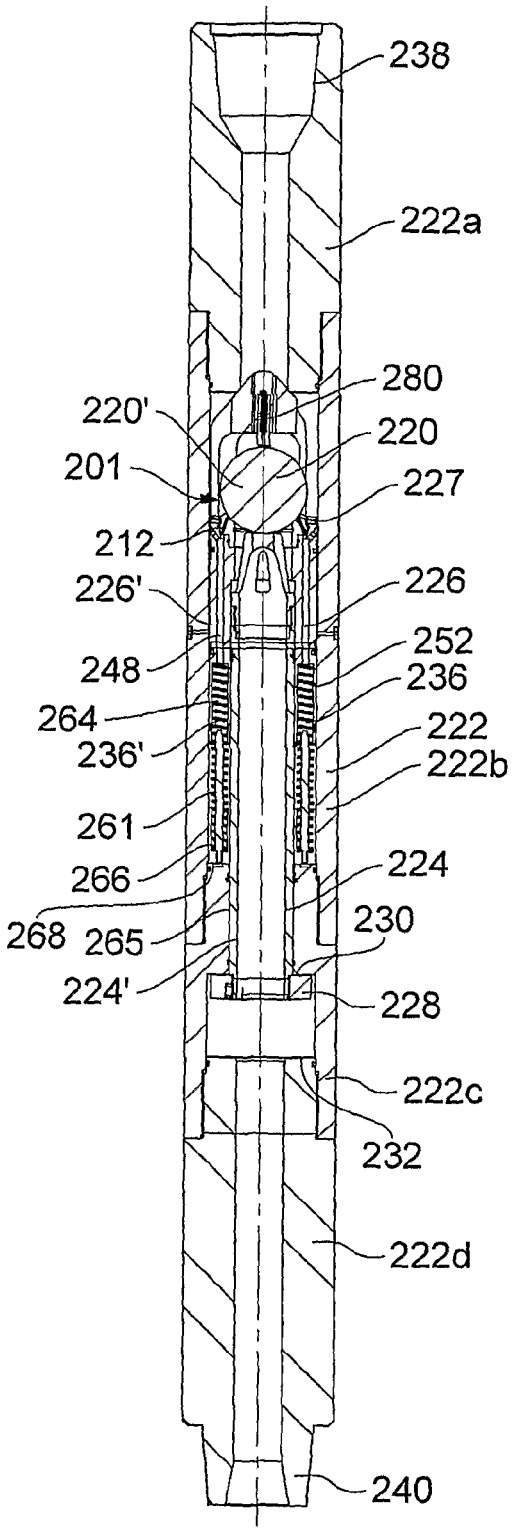
FIG. 9 is a sectional side view of the flow stop valve according to a first embodiment of the disclosure.

With reference to FIG. 9, the flow stop valve 200 according to a first embodiment of the present disclosure is suitable for placement in a downhole tubular operating in a dual fluid density system. (NB, FIG. 9 shows the flow stop valve in a closed position.) The flow stop valve 200 is arranged such that it is in communication with a pressure difference between one of: fluid outside the downhole tubular and inside the downhole tubular, e.g., at the flow stop valve; and fluid above and below the flow stop valve, e.g., either side of the flow stop valve 200 inside the downhole tubular. These pressure differences are substantially the same due to the density and hence the hydrostatic head of the fluid below the flow stop valve inside and outside the downhole tubular being the same. In the particular example shown in FIG. 9, the flow stop valve 200 is arranged such that it is in communication with a pressure difference between fluid outside the downhole tubular and inside the downhole tubular at the flow stop valve.

The flow stop valve 200 comprises a flow restriction means, which in the first embodiment comprises a valve 201 comprising first and second valve elements 226', 220'. As further described below, the first and second valve elements 226', 220' are selectively brought into engagement so as to selectively block the flow passage. The flow restriction means may comprise any other arrangement, for example, a shuttle valve or a variable narrowing in the flow passage.

The flow stop valve 200 according to the first embodiment is substantially the same as the flow stop valve 20 according to the first comparative example. For example, the flow stop valve 200 comprises a housing 222, which may be tubular, and within which there is disposed a third valve element 224'. The third valve element 224' may serve to limit movement of the second valve element 220' and the third valve element 224' may be in the form of a hollow tubular section 224. The housing 222 comprises a box 238 at a first end of the housing and a pin 240 at a second end of the housing. (NB, the first end of a component will hereafter refer to the topmost end as shown in FIG. 9 and accordingly the second end will refer to the bottommost end.) The box 238 and pin 240 allow engagement of the flow stop valve 200 with adjacent sections of a tubular and may comprise conventional box and pin threaded connections, respectively. Although the terms "box" and "pin" are used, any connection to a tubular could be used, for example a socket and plug arrangement. Alternatively, the flow stop valve 200 could be unitary with the tubular.

The first valve element 226' is arranged such that the pressure difference acts across at least a portion of the first valve element and that the first valve element is movable between open and closed positions under action of said pressure difference so as to selectively permit flow through the downhole tubular. The first and second valve elements are in a flow path of the flow stop valve 200 and are arranged to selectively permit and block flow through the flow stop valve. Accordingly, at least a part of the first valve element 226' may be shaped to engage a corresponding portion of the second valve element 220' so that a seal may be selectively formed between the first and second valve elements. For example, the first valve element 226' may comprise a valve seat 227 and the second valve element 220' may comprise a corresponding portion for engaging the valve seat and blocking the flow path.

In the particular embodiment shown in FIG. 9, the first valve element comprises a spherically shaped valve seat 227 for receiving a second valve element, which may also be spherically shaped. The remainder of the first valve element may be in the form of a sleeve 226, which is slidably disposed within the housing 222 about a first end of the hollow tubular section 224, such that the sleeve may slide along the hollow tubular section 224 at its first end, and the sleeve 226 may also slide within the housing 222. A flange 228 is provided at a second end of the hollow tubular section 224 and a first abutment shoulder 230 is provided within the housing 222 between the first and second ends of the hollow tubular section 224 such that the hollow tubular section 224 is slidably engaged within the innermost portion of the first abutment shoulder 230 and the motion of the hollow tubular section 224 in a first direction towards the first end of the housing is limited by the abutment of the flange 228 against the first abutment shoulder 230. (NB, the first direction is hereafter a direction towards the topmost end shown in FIG. 9 and accordingly the second direction is towards the bottommost end.) A second abutment shoulder 232 is provided within the housing 222 and is placed opposite the first abutment shoulder 230, so that the flange 228 is between the first and second abutment shoulders 230, 232.

Furthermore, variable width spacer elements (not shown) may be placed between the second abutment shoulder 232 and the flange 228 and between the first abutment shoulder 230 and flange 228. Motion of the hollow tubular section 224 in either direction may be limited by the abutment of the flange 228 against the spacer elements. The spacer elements may prevent movement of the hollow tubular section 224 altogether. The thickness of the spacer elements may be varied such that the position of the hollow tubular section 224 with respect to the housing 222 may be altered prior to deployment of the flow stop valve downhole. The flange 228 and spacer elements may both have central openings so that the flow of fluid is permitted from the centre of the hollow tubular section 224 to the second end of the flow stop valve 200.

The flow stop valve 200, according to the first embodiment of the disclosure, may also be provided with one or more resilient elements 236', for example springs 236, which may be located between the first abutment shoulder 230 and the sleeve 226. By way of a further example, the one or more resilient elements may comprise one or more sealed fluidic shock absorbers, coiled springs, disc springs, wave springs, rubber springs, Belleville washer or any other element exhibiting resilient properties or any combination thereof. The illustrated springs 236 may resist motion of the sleeve 226 in the second direction. In contrast with the first comparative example, the first embodiment of the present disclosure may comprise a plurality of springs 236 disposed within the circumference of the housing 222. (Alternatively, the first embodiment may comprise a single spring between the first abutment shoulder 230 and the sleeve 226 as per the first comparative example.)

Each spring may comprise a spring guide 261, in the form of a support pin, which passes through the middle of the spring and ensures that the spring does not buckle. The springs may also be provided with first and second spring sleeves 264, 266 in the form of rings, which are disposed within the circumference of the housing 222 and about the circumference of the hollow tubular section 224. The first spring sleeve 264 may define a circular channel in which the one or more springs are located. Similarly, the second spring sleeve 266 may also define a circular channel in which the one or more springs are located. (The first embodiment may alternatively comprise spring sleeves for each spring 236, with each spring sleeve surrounding at least an axial portion of each spring.) The first and second spring sleeves 264, 266 further serve to prevent the spring from buckling. The spring sleeves 264, 266 may be provided at first and second ends of the spring, for example the first spring sleeve 264 may be provided adjacent to the sleeve 226 and may be integral with the sleeve 226, whilst the second spring sleeve 266 may be provided at the other end of the spring. The axial lengths of the spring guides 261 and spring sleeves 264, 266 may be selected so as not to unduly interfere with the compression of the springs.

The housing 222 may be divided into a plurality of component parts. Each component part may be tubular in form with male and female connections at either end so as to interface with respective component parts, thereby forming the complete housing. The component parts may connect together for example by virtue of an interference fit or a threaded connection. In particular, the housing comprises first, second, third and fourth component parts 222*a*, 222*b*, 222*c*, 222*d*, which fit together to form the housing 222. Assembly of the component parts 222*a-d* permits the sleeve 226 and hollow tubular section 224 to be placed within the housing 222. For example, the sleeve 226 is provided within the second component part 222*b* and the hollow tubular section 224 spans the second and third component parts 222*b*, 222*c*. Furthermore, the third component part 222*c* comprises the first abutment shoulder 230 and a male part of the fourth component part forms the second abutment shoulder 232. Similarly, the spring sleeves 266 abut a male part of the third component part 222*c*. The male part of the third component may comprise a bearing ring 268 which sits between the spring sleeves 266 and the third component part 222*c*. The bearing ring may serve to ensure that the springs are not twisted when the second and third component parts 222*b*, 222*c* are rotated with respect to one another during assembly, for example to establish a threaded connection. In other words, the bearing ring 268 may prevent the spring 236 from rotating with respect to the third component part 222*c*. The bearing ring 268 may be located in a groove in the third component part such that the second spring sleeves 266 may slide over the bearing ring. The bearing ring may comprise a copper ring.

At least a portion of the second valve element 220' may be in the form of a spherical member 220, although at least a portion of the second valve element may be any other shape, for example a frustoconical shape. The valve seat portion of the first valve element is shaped to receive a corresponding portion of the second valve element accordingly. The first valve element in the form of sleeve 226 is movably disposed with respect to the spherical member 220 so as to move between the open and closed positions (shown in FIGS. 12*a*-12*c*) selectively permitting the flow between the first and second valve elements and thereby through the downhole tubular. In the embodiment shown in FIG. 9, the spherical member 220 is movably disposed with respect to the sleeve 226 and the spherical member is biased towards the closed position by virtue of a first resilient member 280. In contrast to the embodiment shown, the spherical member 220 may be connected to or unitary with the hollow tubular section 224. Furthermore, the second valve element need not be spherical and may be any other shape.

Figure 10A:
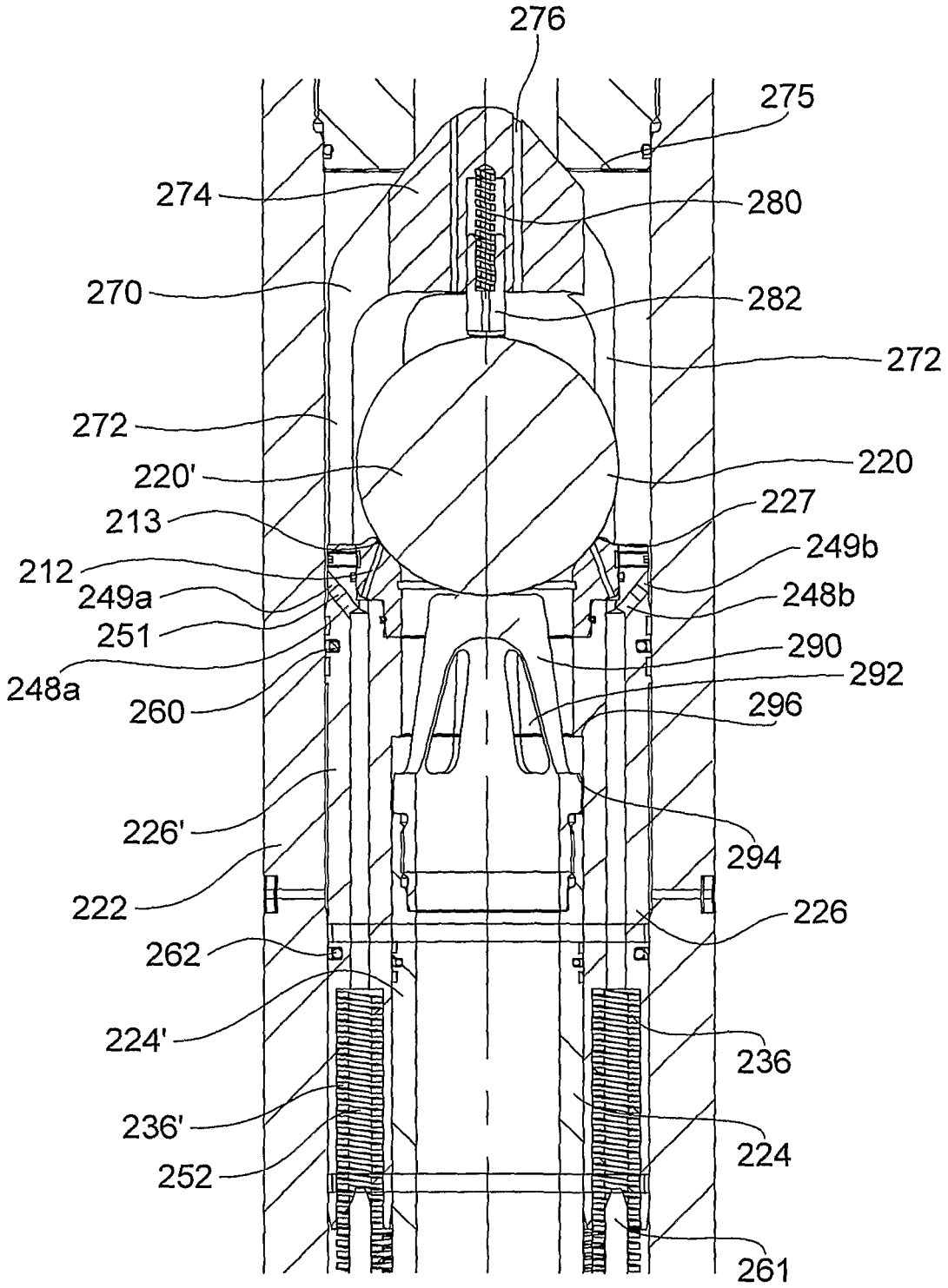
FIG. 10*a* is an exploded sectional side view of the valve arrangement shown in FIG. 9 and FIGS. 10*b* and 10*c* show examples of the valve seat arrangement.
Figure 10B:
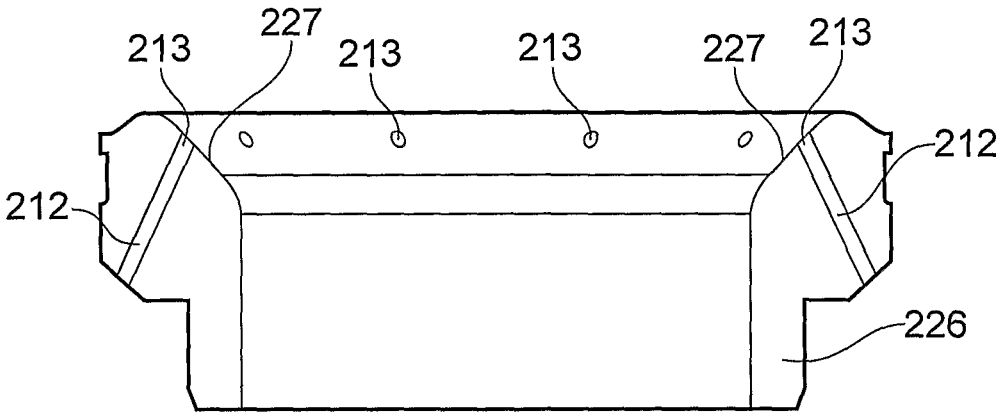
Figure 10C:
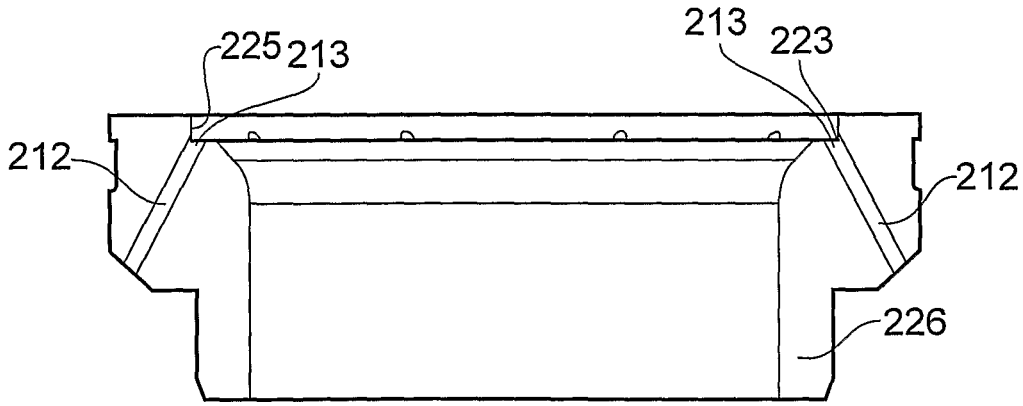

With reference to FIGS. 10*a*-10*c*, the flow stop valve 200 according to the first embodiment is again substantially the same as the flow stop valve 20 according to the first comparative example. (NB, FIG. 10*a* shows the flow stop valve in a closed position.) For example, the sleeve 226 may further comprise one or more second passages 248*a*, 248*b*, which provides a flow passage from the first end of the sleeve to the second end of the sleeve and thence to a first chamber 252, which contains the springs 236. The second passage 248*a*, 248*b* may thus ensure that the pressures acting on the first and second ends of the sleeve 226 are equal. The second passage 248*a*, 248*b* may start from one or more corresponding second ports 249*a*, 249*b* which may be provided on an outer side wall of the sleeve 226, e.g., at a portion of the sleeve which has a smaller diameter than the rest of the sleeve 226 such that there is a gap between the second port 249*a*, 249*b* and the housing wall. (The arrangement of the second port 249*a*, 249*b* is more clearly shown in FIG. 11.) However, the second port 249*a*, 249*b* may be provided on an end wall of the sleeve 226. The second port 249*a*, 249*b*, second passage 248*a*, 248*b* and hence first chamber 252 are in fluid communication with the fluid in the downhole tubular above the flow stop valve 200 when the flow stop valve is in the open and closed positions. The second passage may comprise a filter 251 in order to prevent any debris from entering the first chamber 252.

In contrast to the first comparative example, the first embodiment may further comprise one or more first passages 212 provided in the sleeve 226. The first passages 212 may be arranged so as to transmit fluid from one or more corresponding first ports 213 in the first end of the sleeve to the second end of the sleeve. In particular, the first port 213 may be positioned near to a neck or narrowing of the flow area between the first and second valve elements 226', 220' when the valve is in the open position (see FIG. 12*c*). As a result, the first port 213 may be adjacent to a low pressure flow region when the flow stop valve 200 is in an open position due to the Venturi effect caused by the subsequent increase in flow velocities at the neck or narrowing. The first and second passages 212, 248*a*, 248*b* may join within the sleeve 226 and exit at a common outlet on the second end of the sleeve.

The first port 213 may be arranged such that it is not in fluidic communication with fluid below the flow stop valve in the downhole tubular by the interaction between the sleeve 226 and spherical member 220 when the flow stop valve is in the closed position. In other words, the first port 213 is located at or above the contact point between the sleeve 226 and spherical member 220 so that it is not exposed to the fluid pressure above the flow stop valve when in the closed position. Similarly, the first port 213 may be exposed to the fluid above the flow stop valve in the downhole tubular when the flow stop valve is in the open position. As shown in FIG. 10*b*, the sleeve 226 may comprise a valve seat portion 227 spherically shaped to receive the spherical member 220 and the first port 213 may be provided within the valve seat portion or the first port 213 may be provided above the valve seat portion. Furthermore, as shown in FIG. 10*c*, the first port 213 may alternatively be provided within an annular shoulder 225 provided within the sleeve 226 and the first port 213 may be provided within a corner 223 of the annular shoulder 225. The first port 213 of the arrangement shown in FIG. 10*b* may be exposed to a higher velocity flow and hence a lower low pressure flow region. The arrangement shown in FIG. 10*c* may normalise the pressures seen at the first port 213 and may communicate a more stable pressure to the first passage 213.

As is shown in FIG. 10*a*, the flow stop valve 200 according to the first embodiment of the present disclosure may further comprise a support structure 270. The support structure 270 may be connected to the sleeve 226 and may move with the sleeve 226 within the housing 222. The support structure may comprise a plurality of legs 272 which may be circumferentially distributed about the support structure and connect a head portion 274 of the support structure to the sleeve 226. Movement of the sleeve 226 and support structure 270 may be limited by the head portion 274 abutting an abutment shoulder 275 formed by a male portion of the first housing component part 222*a*. The legs 272 and head portion 274 of the support structure 270 may surround the spherical member 220. The spherical member 220 may be free to move within the support structure such that the spherical member may be in the closed position in which the spherical member is seated, e.g., seated against a portion of the sleeve 226, or in the open position, e.g., in which there is a gap 229 (as shown in FIGS. 12*c* and 13 described below) between the spherical member and the sleeve 226.

The head portion 274 may comprise first resilient member 280 which may be in the form of a spring as shown, but may alternatively be a sealed fluidic shock absorber, coiled spring, disc spring, wave spring, rubber spring, Belleville washer or any other element exhibiting resilient properties. A cap 282 may be provided at an end of the resilient member, wherein the cap contacts the spherical member 220. The resilient member 280 biases the spherical member 220 into engagement with the sleeve 226. An opening 276 in the head portion 274 may be provided, e.g., about the first resilient member 280, to ensure that flow can penetrate the support structure 270 in the event that the head portion 274 abuts the first housing component 222*a*. The opening 276 permits the upstream flow pressure to be communicated to the spherical member 220 and sleeve 266 in the event that the head portion 274 of the support structure 270 abuts and forms a seal around the first housing component 222*a*. The communication of this pressure may be desirable as the area of the head portion 274 exposed to the fluid above the flow stop valve may alone not be sufficient to provide a pressure force to overcome the initial force in springs 236. Furthermore, the spherical member 220 may function as a one-way flow valve allowing flow in the first direction in the event that there is a back pressure urging fluid up the tubular. The head portion 274 of the support structure 270 surrounding the spherical member 220 ensures that the spherical member 220 is free to move in a first direction even if the head portion is in abutment with the first housing component 222*a*.

In contrast to the first comparative example, the hollow tubular section 224 of the first embodiment may not comprise a piston head. Instead, the hollow tubular section 224 of the first embodiment may comprise a contact portion 290, which may be a truncated cone shape. The contact portion 290 may comprise one or more openings, e.g. holes 292 dispersed about the circumference of the contact portion 290. The hollow tubular section 224 may further comprise an abutment shoulder 294 which engages with a corresponding abutment shoulder 296 on an inner surface of the sleeve 226. The abutment surfaces 294, 296 may limit movement of the sleeve 226 in the second direction.

As for the first comparative example, when the pressure difference across the sleeve 226 of the first embodiment is sufficiently high, the sleeve 226 may move in the second direction. The hollow tubular section 224 of the first embodiment may be fixed in position by the spacers either side of the flange 228. The spherical member 220 may initially move with the sleeve 226 in the second direction due to the effect of the resilient member 280 and the pressure difference acting across the spherical member 220. However, beyond a certain point, the spherical member may contact the contact portion 290 of the hollow tubular section 224 and the spherical member 220 may no longer move with the sleeve 226. Therefore, as the sleeve moves further in the second direction, a gap 229 (as shown in FIGS. 12*c* and 13 described below) is formed between the spherical member 220 and the sleeve 226 and the flow stop valve 200 is in the open position. Once in the open position (as shown in FIG. 12*c*), flow can pass around the head portion 274 and between the legs 270 of the support structure 270 and through the gap 229 between the spherical member 220 and the sleeve 226. Fluid can then pass through the holes 292 of the contact portion 290 into the hollow tubular section 224 and thence to the second end of the flow stop valve 200.

Figure 11:
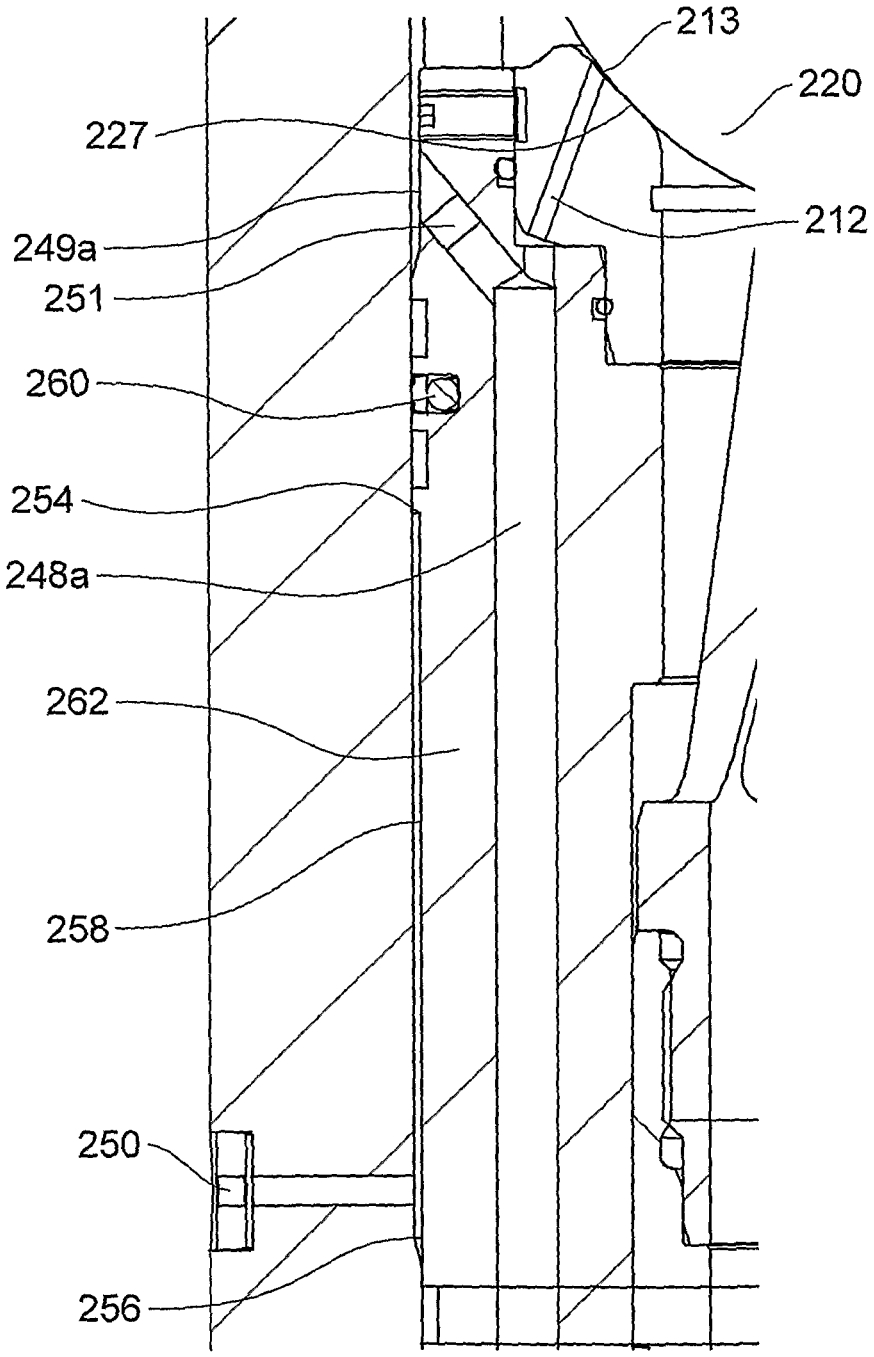
FIG. 11 is a further exploded sectional side view of the valve arrangement shown in FIG. 9.

With reference to FIG. 11, the flow stop valve 200 according to the first embodiment is again substantially the same as the flow stop valve 20 according to the first comparative example. (NB, FIG. 11 shows the flow stop valve in a closed position.) For example, the projected area of the first end of the sleeve 226 may be greater than the projected area of the second end of the sleeve 226 so that the force due to the pressure acting on the first end of the sleeve 226 is greater than the force due to the pressure acting on the second end of the sleeve 226. This area difference may be achieved by virtue of a fourth abutment shoulder 254 in the sleeve 226 and a corresponding fifth abutment shoulder 256 in the housing 222. The fourth abutment shoulder 254 may be arranged so that the diameter of the sleeve 226 at its first end is greater than that at its second end and furthermore, motion of the sleeve 226 in the second direction may be limited when the fourth and fifth abutment shoulders 254, 256 abut. The fourth and fifth abutment shoulders 254, 256, together with the sleeve 226 and housing 222 may define a second chamber 258 and a housing vent 250 may be provided in the side-wall of the housing 222 so that the second chamber 258 may be in flow communication with the fluid outside the flow stop valve 200. The net pressure force acting on the sleeve 226 is therefore the product of (1) the difference between the pressure outside the flow stop valve 200 and at the first end of the flow stop valve 200, and (2) the area difference between the first and second ends of the sleeve.

Seals 260, 262 (the latter being shown in FIG. 10) may be provided at the first and second ends of the sleeve 226 respectively so that the second chamber 258 may be sealed from the first end of the flow stop valve 200 and the first chamber 252 respectively. Furthermore, seals 265 (see FIG. 9) may be provided on the innermost portion of the first abutment shoulder 230 so that the first chamber 252 may be sealed from the second end of the flow stop valve 200.

Figure 12A:
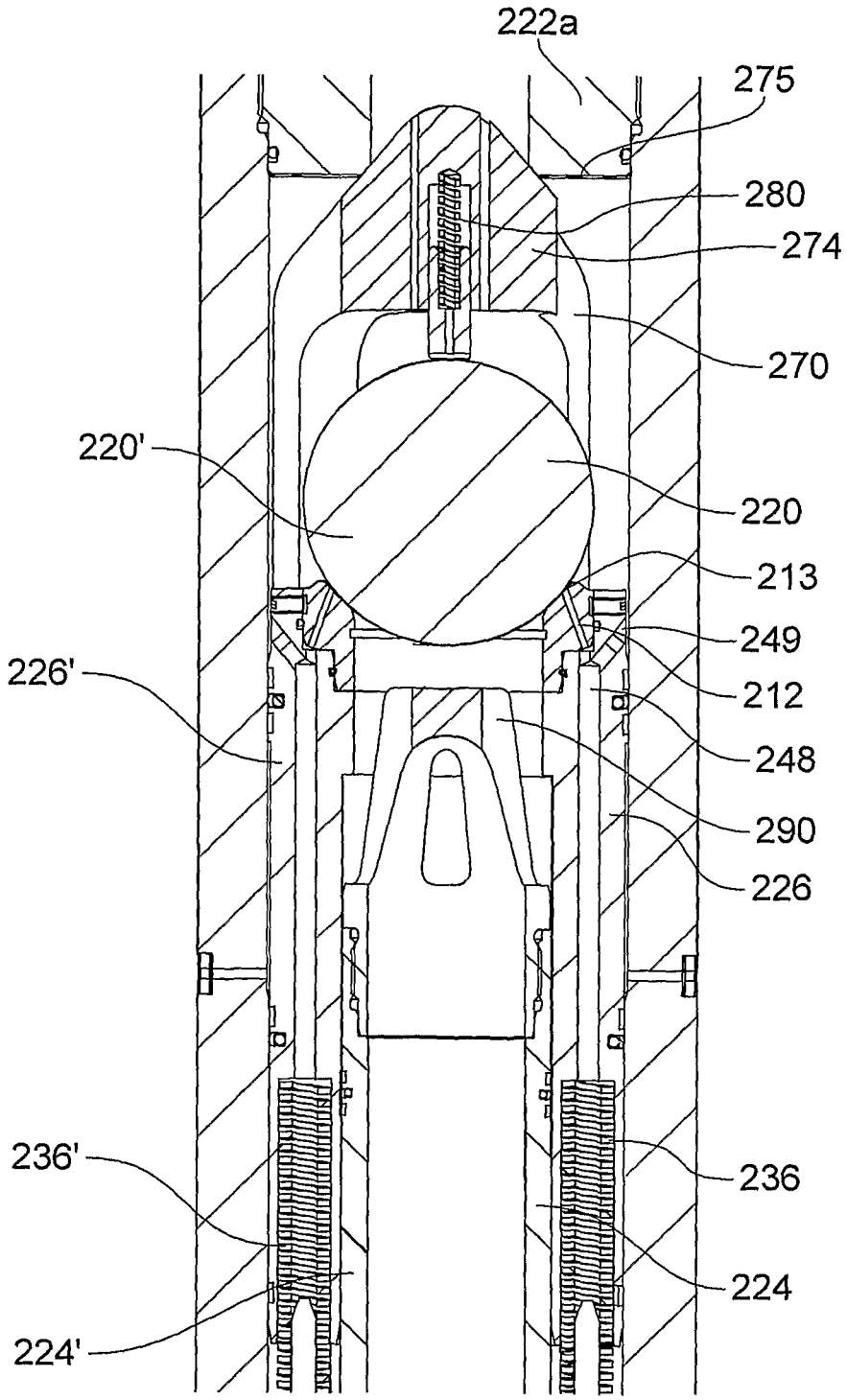
FIGS. 12*a*, 12*b* and 12*c* are sectional side-views of the flow stop valve in the closed, pre-loaded and open positions according to a first embodiment of the disclosure.
Figure 12B:
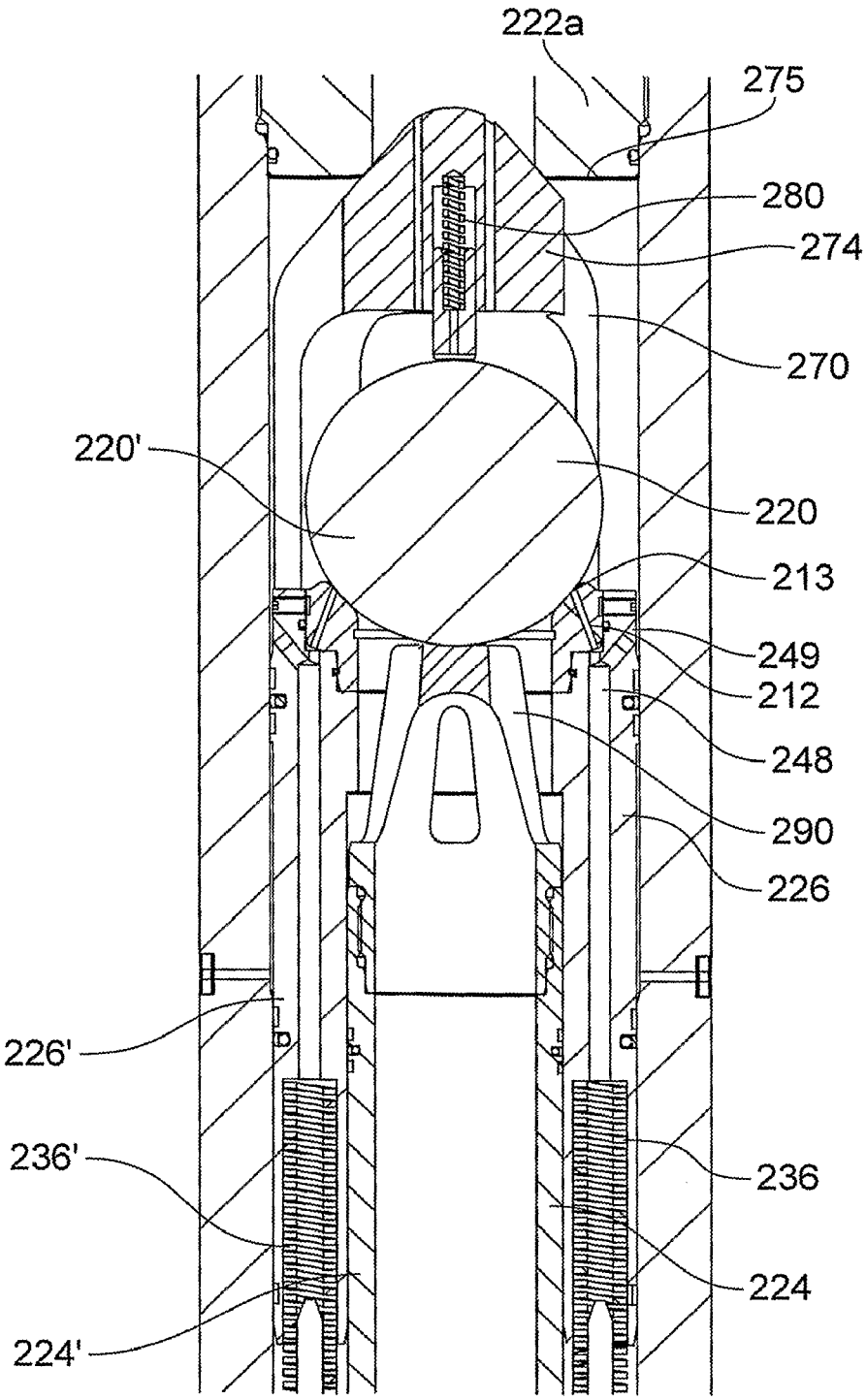
Figure 12C:
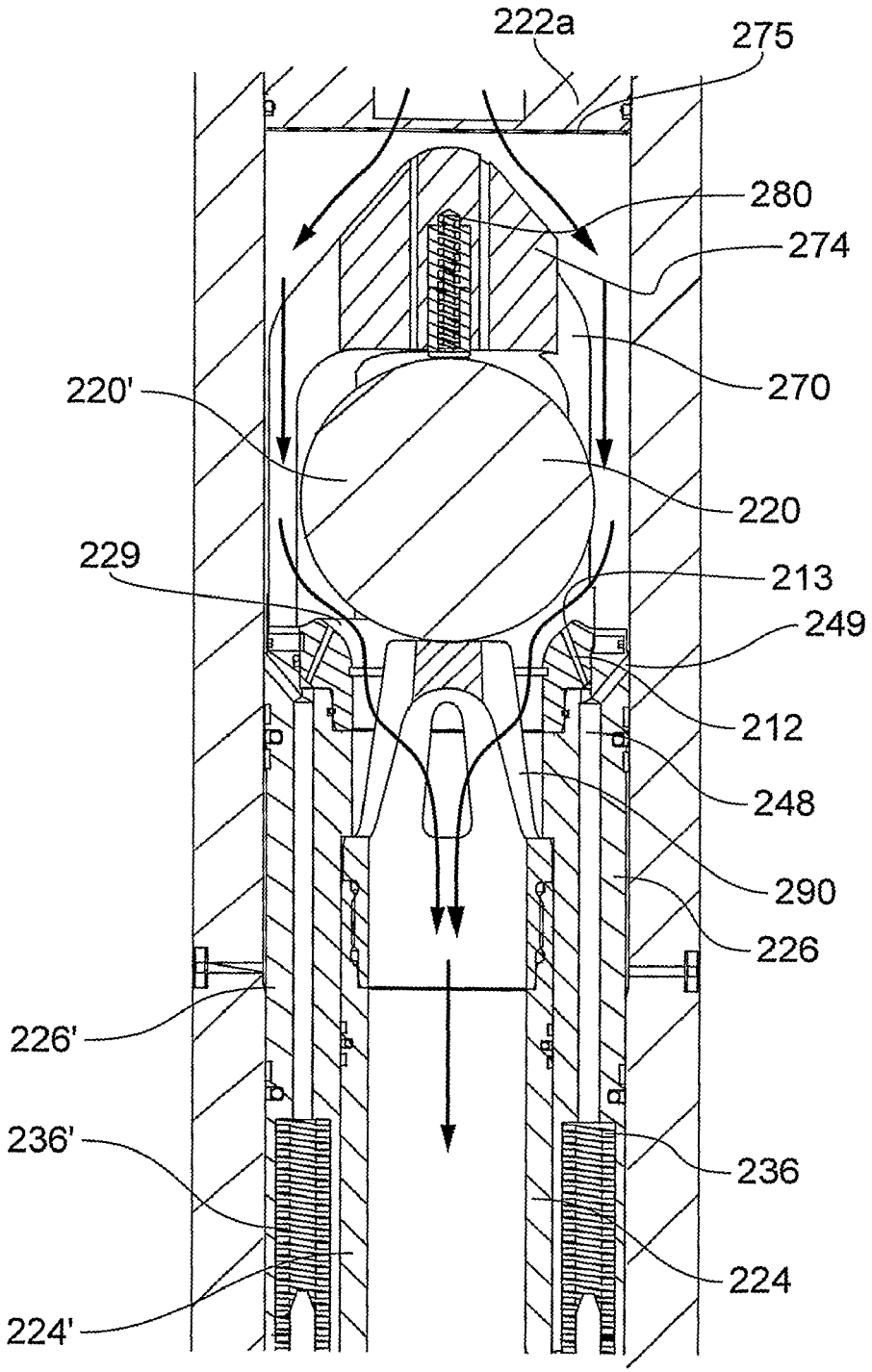
Figure 13:
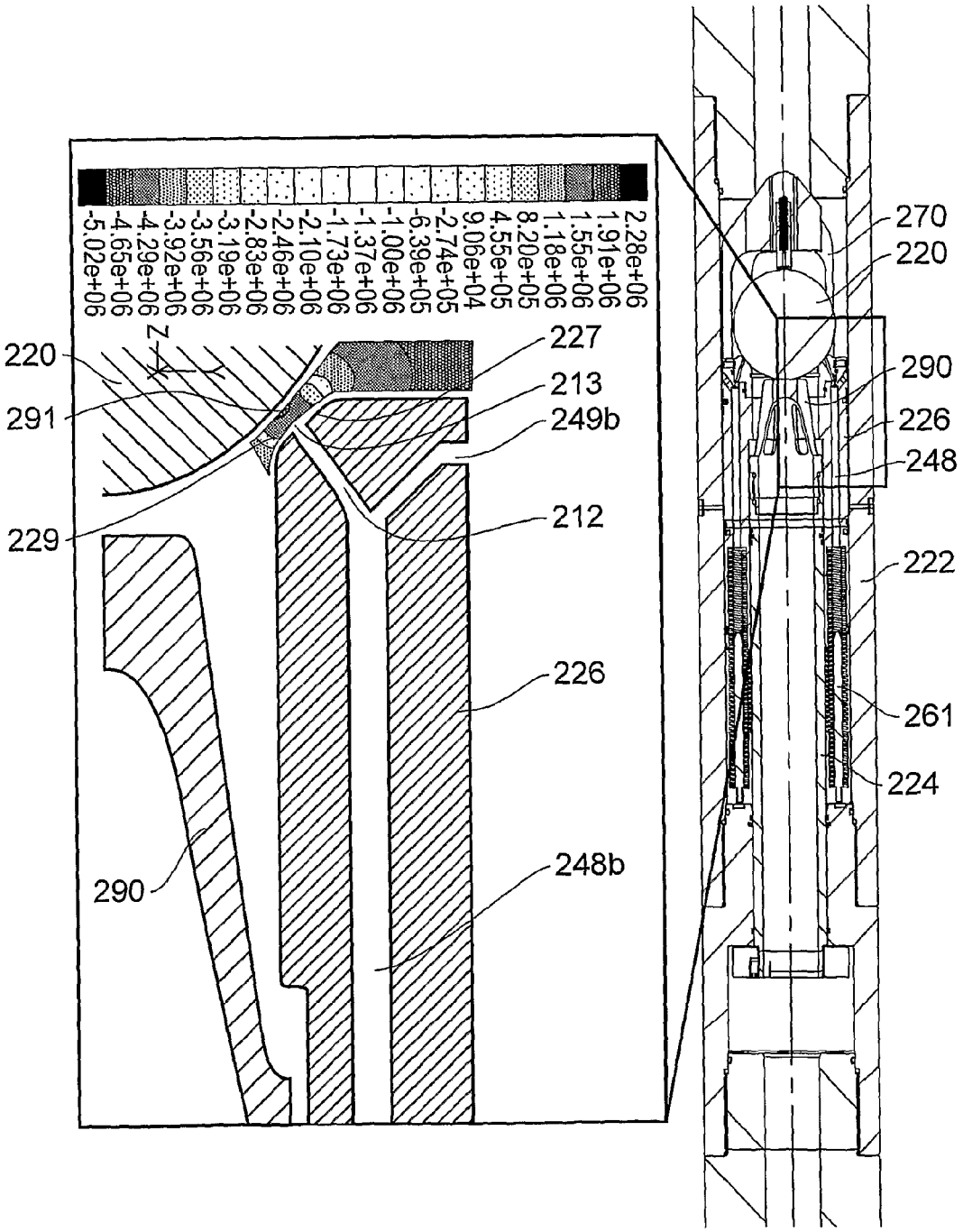
FIG. 13 is a sectional side view of the flow stop valve according to a first embodiment of the disclosure showing an enlargement of the valve arrangement and the associated pressure contours.

With reference to FIGS. 12*a* to 12*c*, the operation of the flow stop valve 200, according to the first embodiment of the disclosure, will now be explained. The flow stop valve 200 may be located in a tubular with the first end above the second end and the flow stop valve 200 may be connected to adjacent tubular sections via the box 238 and pin 240. Prior to lowering of the tubular into the wellbore (e.g., the riser of an offshore drilling rig), there may be a small preload in the springs 236 so that the support structure 270 abuts the abutment shoulder 275, as shown in FIG. 12*a*. Furthermore, in the depicted embodiment, the spherical member 220 abuts the sleeve 226 by virtue of the resilient member 280 and the pressure difference across the spherical member 280. With the spherical member in this position no drilling fluid may pass through the flow stop valve 200.

As the tubular and hence flow stop valve 200 is lowered into the riser, the hydrostatic pressures inside and outside the tubular and flow stop valve 200 begin to rise. With one example of a dual density drilling fluid system, the density of the fluid within the tubular may be higher than the density of the fluid between the riser and the tubular, and the hydrostatic pressures within the tubular (and hence those acting on the spherical member 220 and first and second ends of the sleeve 226) therefore increase at a greater rate than the pressures between the riser and the tubular. The resulting difference between the pressures inside and outside the tubular may increase until the seabed is reached, beyond which point the fluids inside and outside the tubular may have the same density and the pressures inside and outside the tubular may increase at the same rate.

Before the flow stop valve 200 reaches the seabed, the increasing pressure difference between the inside and outside of the tubular also acts on the spherical member 220 because the top (first) end of the flow stop valve 200 is not in flow communication with the bottom (second) end of the flow stop valve 200. The same pressure difference may also act on the difference in areas between the first and second ends of the sleeve 226. However, this area difference may be smaller than the projected area of the spherical member 220 exposed to the pressure difference across the flow stop valve 200. Therefore, as the flow stop valve 200 is lowered into the riser, the force acting on the spherical member 220 may be greater than the force acting on the sleeve 226. Once the forces acting on the spherical member 220 and sleeve 226 overcome a small initial load in the springs 236, the sleeve 226 may be moved downwards (i.e., in the second direction) and because the force on the spherical member 220 may be greater than that on the sleeve 226, the spherical member 220 remains abutted against the sleeve 226. (The length and/or stiffness of springs 236, and hence their initial load may be pre-selected to ensure that the head portion 274 of the support structure 270 initially abuts the abutment shoulder 275 of first housing component part 222*a* before lowering into the riser.)

The combined movement of the sleeve 226 and spherical member 220 may continue until the spherical member 220 abuts the contact portion 290 of the hollow tubular section 224 and the spherical member 220 may no longer move with the sleeve 226, as shown in FIG. 12*b*. The flow stop valve 200 is then in a "fully preloaded" state. The pressure difference at which this occurs, and the resulting force in the springs, may be varied by changing the thickness of the spacer elements. With a larger spacer element beneath the flange 228 (and consequently a smaller spacer element above the flange) the hollow tubular section 224 will be higher up and the sleeve 226 and spherical member 220 will travel a shorter distance before the flow stop valve 200 is preloaded. The opposite applies for a smaller spacer element below the flange. The size of the spacer elements above and below the flange 228 may be selected before installing the flow stop valve 200 into the tubular. For example, differently sized or multiple spacer elements may be inserted above and/or below the flange 228 prior to connecting the third and fourth component parts 222*c*, 222*d* of the housing 222 together.

The thickness of the spacer elements beneath the flange 228 can determine the preload in the springs 236 in the preloaded state. In such an embodiment, it is the preload in the springs against which the pressure difference has to overcome to move the sleeve 226 any further after the spherical member 220 has abutted the contact portion 290. The thickness of such spacer elements therefore determines the depth of the flow stop valve at which the preload in the springs is overcome such that the sleeve may move further and the valve opens. For example, with a larger spacer element beneath the illustrated flange 228, the flow stop valve 200 will open at a lower pressure difference.

Once the spherical member 220 cannot move any further, due to abutment with the contact portion 290, the flow stop valve 200 is in the fully preloaded state, as shown in FIG. 12*b*. In one embodiment, in the fully preloaded state, the force acting on the sleeve 226 is not yet sufficient to overcome the spring force, because the pressure difference acting on the sleeve 226 acts over a much smaller area than when the pressure difference had additionally acted on the spherical member 220. The sleeve 226 may therefore remain in contact with the spherical member 220 and the flow stop valve may stay closed until the pressure difference is sufficiently high to move the sleeve 226 independently of the spherical member. The flow stop valve 200 may be lowered further for the pressure difference acting on the sleeve 226 to increase. The spacer elements thickness may be selected so that once the flow stop valve 200 reaches the seabed, the pressure difference and hence pressure forces acting on the sleeve 226 at this depth are just less than the spring force in the fully preloaded state. At the seabed the pressure forces are therefore not sufficient to move the sleeve 226, but a further increase in the pressure upstream of the flow stop valve may be sufficient to overcome the spring force in the fully preloaded state and move the sleeve 226. However, as the flow stop valve 200 is lowered below the seabed, the pressure difference may not increase any more (for the reasons explained above) and hence the flow stop valve will remain closed. Once the tubular is in place and the flow of drilling fluid is desired, an additional "cracking" pressure may be applied by the drilling fluid pumps, which may be sufficient to overcome the fully preloaded spring force, thereby moving the sleeve 226 downwards (in the second direction) and permitting flow through the flow stop valve 200, as shown in FIG. 12*c*. The cracking pressure of the flow stop valve may be varied to suit the particular application, e.g. the depth of the water at the seabed and/or the densities of the fluids. The cracking pressure may for example be varied by selecting spring forces and/or spring lengths of springs 236 or by including spacer elements or by varying the area of the fourth and fifth abutment shoulders 254, 256. By way of example, the cracking pressure may be in the range of 3 to 500 psi (20 to 3448 kPa), but may also be outside this range. Once the valve is in the open position, fluid is able to flow between the first and second valve elements 226', 220' and hence through the flow stop valve 200, as indicated by the arrows shown in FIG. 12*c*.

As an aside, it is to be noted that once the flow stop valve is below the seabed, the pressure difference across the flow stop valve (from above to below) is substantially the same as the pressure difference between inside and outside the tubular just above the flow stop valve 200. This is because the fluid just below the flow stop valve and inside the downhole tubular has the same density as the fluid just below the flow stop valve and outside the downhole tubular (see FIG. 1*b*). Therefore, the hydrostatic pressure of the fluid outside the flow stop valve may be the same as that inside the downhole tubular just below the flow stop valve. (By contrast, the pressure of the fluid inside the downhole tubular above the flow stop valve 200 may be different from that outside the flow stop valve 200 because the density of the fluid above the flow stop valve and inside the downhole tubular is different from the density of the fluid above the flow stop valve and outside the downhole tubular, as shown in FIG. 1*b*.) It therefore follows that, before the flow stop valve 200 opens, the pressure difference between fluid on the first and second sides of the valve may be substantially the same as the pressure difference between fluid inside and outside the valve at a point just above the valve (neglecting the hydrostatic pressure difference between above and below the valve outside of the valve as this may be relatively small in comparison to the depths involved).

In general terms, the position at which further movement of the second valve element 220' is prevented, e.g. by the spacer elements, determines the preload in the resilient elements 236' against which the pressure difference acting on the first valve element 226' has to overcome to move the first valve element independently of the second valve element and open the flow stop valve.

By preventing flow until the drilling fluid pumps provide the "cracking" pressure, the flow stop valve 200 described above may solve the aforementioned problem of the fluid in the tubular displacing the fluid outside the tubular due to the density differences and resulting hydrostatic pressure imbalances.

Although the above has referred to a process of lowering the flow stop valve, for example prior to drilling, the flow stop valve may also be utilised in a non lowering dual density application. For example, the flow stop valve may also be utilised when raising a tubular, e.g. raising a drill string from the well after drilling. The flow stop valve may also be used in a circulation mode for example, during drilling or during extraction of fluids, e.g. oil, from a well. In such a mode of operation, the flow stop valve may ensure that when the flow of fluid stops the denser drilling fluid in the tubular does not displace the less dense fluid outside the tubular.

With reference to FIG. 13 an enlarged section of the spherical member 220 and the valve seat of the sleeve 226 is shown. FIG. 13 also shows contours of constant pressure of the fluid when the flow stop valve 200 is in an open position, e.g., when the sleeve 226 and spherical member 220 have moved apart (the pressure values correspond to a pressure in Pascals with respect to a datum). There is a low fluid pressure region 290 between the sleeve 226 and the spherical member 220 because there is a narrowing of the flow area at this point, which increases the flow velocities and hence reduces the pressure. In other words, the low pressure at the low pressure region 290 is as a result of the Venturi effect. The low pressure flow region 290 may correspond to a high flow velocity region when the flow stop valve 200 is in an open position. The low pressure flow region may correspond to a restriction or narrowing in the cross-sectional flow area.

The first port 213 of the first side of the sleeve 226 is positioned so that it is adjacent to this low pressure region when the valve is in the open position. (By contrast, the low pressure flow region 290 may not exist when the flow stop valve 200 is in a closed position as fluid is not flowing through the flow stop valve 200.) The first port 213 is positioned in the vicinity of this low pressure region so that the low pressure that exists once the flow stop valve 200 is opened is also transmitted to the second side of the sleeve 226. The pressure force urging the flow stop valve to close is therefore reduced and thus any tendency for the flow stop valve 200 to chatter or not fully open has also been reduced. Valve chatter (e.g., undesirable, relatively rapid opening and closing of the valve) or partial opening otherwise occurs when a valve requires a certain pressure to open the valve, and the pressure reduces on opening the valve due to the increase in the flow velocity (owing to the Bernoulli effect). There may therefore be a tendency for the valve to close because of the reduction in pressure on opening. Once the valve closes, the pressure increases as the flow has stopped and the process repeats itself causing the valve to chatter. The present invention serves to mitigate against this effect by reducing the pressure force on the second side of the sleeve 226 (via the first port 213 and second passage 248*a*, 248*b*) once the valve is open, thereby reducing the force urging the valve to close.

Figure 14:
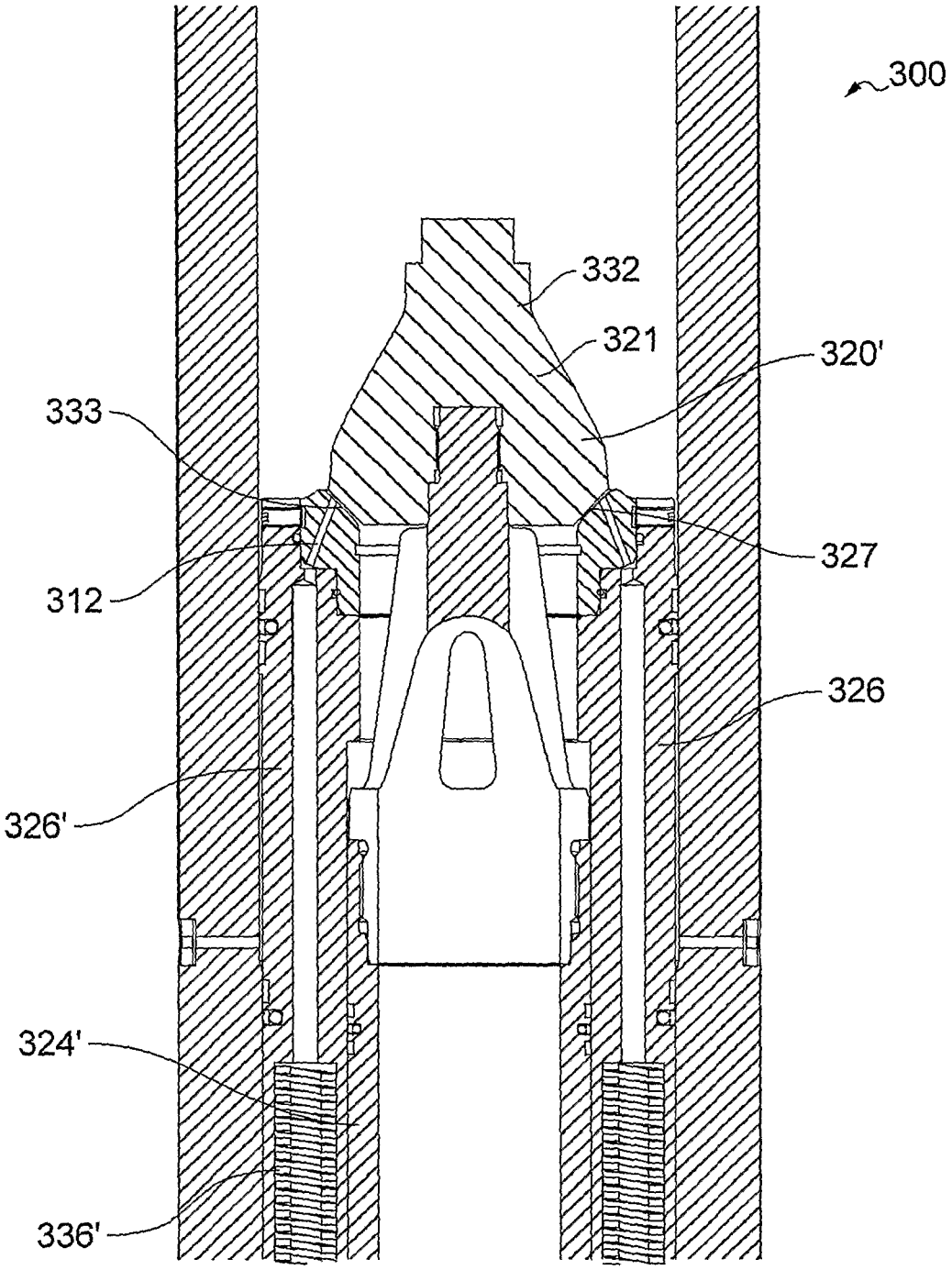
FIG. 14 is a sectional side view of the flow stop valve according to a second embodiment of the disclosure.

With reference to FIG. 14, a flow stop valve 300 according to a second embodiment of the present disclosure, comprises a valve 301 comprising first and second valve elements 326', 320', which may be selectively brought into engagement so as to selectively block the flow passage. As for the first embodiment, the first valve element of the second embodiment may be in the form of a sleeve 326 and the first valve element 326' may comprise a valve seat 327 for receiving the second valve element 320'. The second valve element 320' of the second embodiment is shaped at a second end to be received by the valve seat 327 so as to form a seal between the first and second valve elements 326', 320'. The second valve element 320' may comprise a frustoconical portion 321 and may further comprise a cylindrical portion 322.

In contrast to the first embodiment, the second valve element 320' of the second embodiment is connected to a third valve element 324'. In the particular case of the second embodiment, the second valve element 320' may be threadably connected to the third valve element 324', but the second valve element 320' may be connected to the third valve element 324' by any other means and may also be unitary with the third valve element 324'. In this respect the second embodiment is similar to the first comparative example with the second valve element 320' being equivalent to the piston head 44 of the first comparative example. As a consequence the flow stop valve 300 of the second embodiment does not comprise the support structure 270 of the first embodiment.

The flow stop valve 300 of the second embodiment comprises a first passage 312 provided in the sleeve 326. The first passage 312 may be arranged so as to transmit fluid from a first port 313 in the first end of the sleeve to the second end of the sleeve. In particular, the first port 313 may be positioned near to a neck or narrowing of the flow area between the first and second valve elements 326', 320' when the valve is in the open position. As a result, the first port 313 may be adjacent to a low pressure flow region when the flow stop valve 300 is in an open position due to the Venturi effect caused by the subsequent increase in flow velocities at the neck or narrowing.

The second embodiment otherwise functions in the same way as the first embodiment. In other words, the position at which further movement of the second valve element 320' is prevented, e.g. by the spacer elements, determines the preload in resilient elements 336' against which the pressure difference acting on the first valve element 326' has to overcome to move the first valve element independently of the second valve element and open the flow stop valve.

Figure 15:
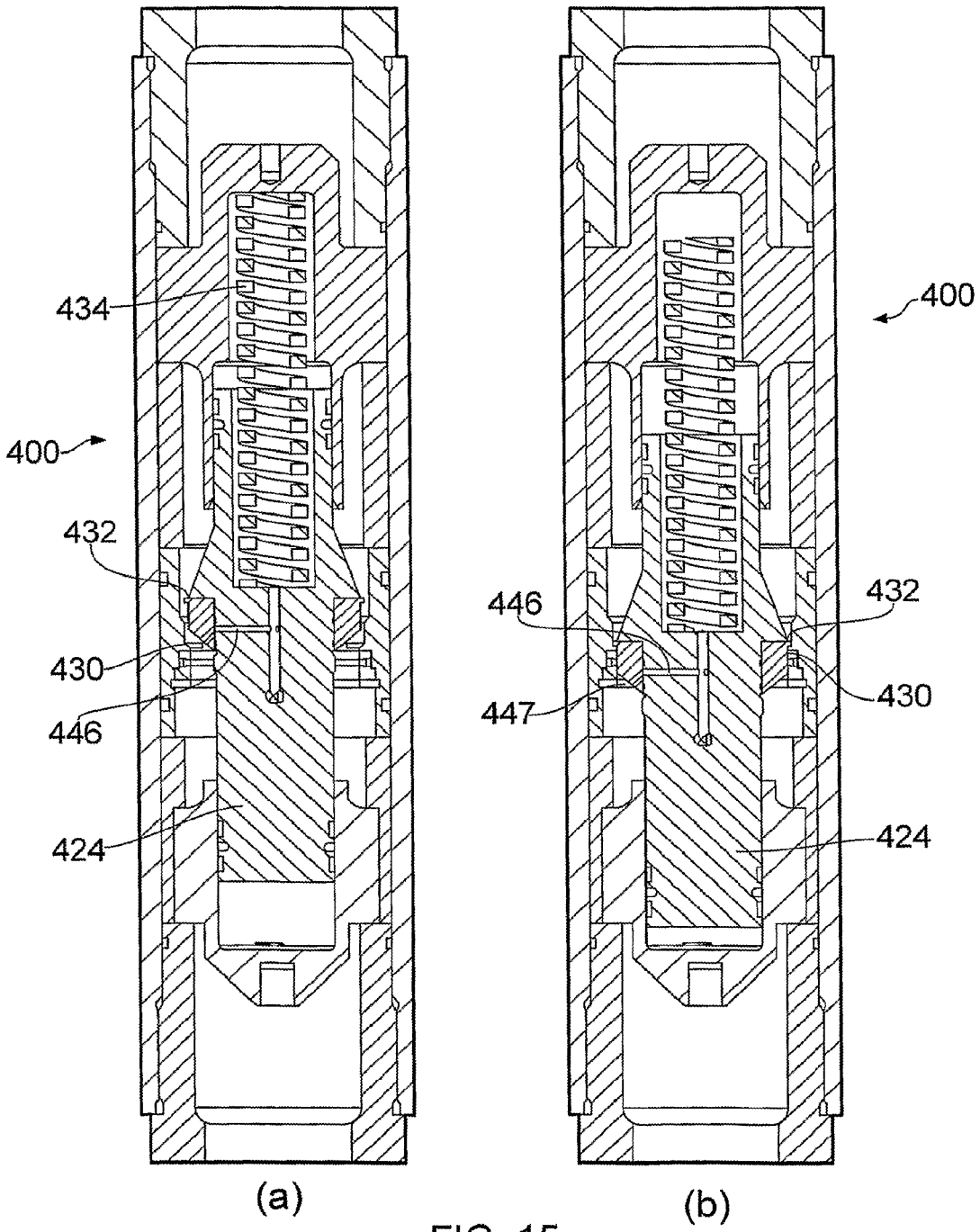
FIGS. 15*a* and 15*b* are sectional side views of the flow stop valve in an open position (FIG. 15*a*) and a closed position (FIG. 15*b*) according to a third embodiment of the disclosure.

With reference to FIGS. 15*a* and 15*b*, a flow stop valve 400 according to a third embodiment of the present disclosure is substantially the same as the third comparative example of the disclosure. For example, the flow stop valve 400 may be located in a tubular being lowered into a well bore, such that, when a tubular is in position for cementing within the wellbore, the flow stop valve is at any point in the tubular between the seabed and the bottom of the tubular. In particular, the flow stop valve 400 may be located at the bottom of a casing string, for example, at a casing shoe and a cement slurry may flow through the flow stop valve. FIG. 15*a* shows the flow stop valve 400 in an open position, whilst FIG. 15*b* shows the flow stop valve 400 in a closed position. As for the third comparative example, movement of the spindle 424 determines whether the first and second annular abutment surfaces 430, 432 are in contact and accordingly whether the flow stop valve is in an open or closed position. The spindle 424 is thus equivalent to the first valve element of the first embodiment.

The third embodiment differs from the third comparative example in that a second passage 446 in spindle 424 exits at a port 447, which is in the vicinity of the first and second annular abutment surfaces 430, 432. In particular, the port 447 may be positioned near to a neck or narrowing of the flow area between the first and second annular abutment surfaces 430, 432 when the valve is in the open position. As a result, the port 447 may be adjacent to a low pressure flow region when the flow stop valve 400 is in an open position due to the Venturi effect caused by the subsequent increase in flow velocities at the neck or narrowing. The port 447 is positioned in the vicinity of this low pressure region so that the low pressure that exists once the flow stop valve 300 is opened is transmitted to the first chamber 434. The pressure force urging the flow stop valve to close is therefore reduced. As a consequence the tendency for the flow stop valve 400 to chatter or only partially open has also been reduced.

Valve chatter or partial opening otherwise occurs when a valve requires a certain pressure to open the valve, and the pressure reduces on opening the valve due to the increase in the flow velocity (owing to the Bernoulli effect). There may therefore be a tendency for the valve to close because of the reduction in pressure on opening. Once the valve closes, the pressure increases as the flow has stopped and the process repeats itself causing the valve to chatter. The present invention serves to mitigate against this effect by reducing the pressure force on the first side of the spindle 424 (via the port 447 and second passage 446) once the valve is open, thereby reducing the force urging the valve to close The third embodiment otherwise operates in the same way as the third comparative example described above.

While the invention has been presented with respect to a limited number of examples, those skilled in the art, having benefit of this disclosure, will appreciate that other embodiments may be devised which do not depart from the scope of the present disclosure.

The invention claimed is:

1. A flow stop valve for placement in a downhole tubular operating in a dual fluid density system, wherein the flow stop valve is in communication with a pressure difference between fluid outside the downhole tubular and inside the downhole tubular at the flow stop valve, or between fluid above and below the flow stop valve inside the downhole tubular, wherein the flow stop valve comprises:

a first valve element arranged such that the pressure difference acts across at least a portion of the first valve element, wherein the first valve element comprises a first passage to transmit fluid from a first port in a first side of the first valve element through a second side of the first valve element to a first chamber, the first port being positioned adjacent to a low pressure flow region when the flow stop valve is in an open position such that the low pressure flow region is in fluidic communication with the first chamber via the first port and the first passage;

a second valve element, wherein the low pressure flow region is at least partially defined in a gap between the second valve element and the first valve element when the flow stop valve is in the open position, and wherein the first valve element is configured to move in a downhole direction with respect to the second valve element to actuate the flow stop valve from a closed position to the open position; and a resilient member disposed in the first chamber, the resilient member applying a biasing force on the first valve element, the biasing force being oriented so as to force the first valve element toward the second valve element, such that the biasing force causes the flow stop valve to actuate to the closed position when the pressure difference is below a threshold value.

2. The flow stop valve of claim 1, wherein the flow stop valve selectively permits flow between the first and second valve elements and thereby through the downhole tubular when in the open position.

3. The flow stop valve of claim 2, wherein the first port is arranged such that it is not in fluidic communication with fluid in the downhole tubular and below the flow stop valve by the interaction between the first and second valve elements when the flow stop valve is in the closed position and the first port is in fluidic communication with the fluid in the downhole tubular and below the flow stop valve when the flow stop valve is in the open position.

4. The flow stop valve of claim 3, wherein the second valve element is substantially spherical and the first valve element comprises a corresponding valve seat portion adapted to receive the second valve element, the first port being provided within the valve seat portion.

5. The flow stop valve of claim 2, wherein the flow stop valve further comprises a third valve element, wherein the third valve element is disposed so as to limit the movement of the second valve element.

6. The flow stop valve of claim 1, further comprising another resilient member, the another resilient member applying a biasing force on the second valve element in a downhole direction, toward the first valve element.

7. The flow stop valve of claim 1, wherein the flow stop valve is biased so as to prevent flow of fluid from an uphole side of the flow stop valve to a downhole side of the flow stop valve.

8. A method of controlling flow in a downhole tubular operating in a dual fluid density system, the method comprising:

restricting flow through the downhole tubular by closing a flow stop valve when a pressure difference between fluid outside the downhole tubular and inside the downhole tubular at the flow stop valve, or between fluid above and below the flow stop valve inside the downhole tubular, is below a threshold value, wherein the flow stop valve comprises:

a first valve element arranged such that the pressure difference acts across at least a portion of the first valve element, wherein the first valve element comprises a first passage to transmit fluid from a first port in a first side of the first valve element through a second side of the first valve element to a first chamber;

a second valve element, wherein a low pressure flow region is defined at least partially in a gap between the first and second valve elements when the flow stop valve is in an open position, and wherein the first valve element is configured to move in a downhole direction with respect to the second valve element to actuate the flow stop valve from a closed position to the open position; and a resilient member disposed in the first chamber, the resilient member applying a biasing force on the first valve element, the biasing force being oriented so as to force the first valve element toward the second valve element, such that the biasing force causes the flow stop valve to actuate to the closed position when the pressure difference is below the threshold value;

permitting flow through the downhole tubular by opening the flow stop valve when the pressure difference is above the threshold value, wherein the flow stop valve opens in response to a first valve element moving in a downhole direction with respect to a second valve element; and transmitting fluid from the first port of the first valve element to the first chamber, the first port being positioned adjacent to a low pressure flow region when the flow stop valve is in the open position such that the low pressure flow region is in fluidic communication with the first chamber via the first port.

9. The method of claim 8, wherein the method further comprises:

arranging the first port such that it is not in fluidic communication with fluid in the downhole tubular and below the flow stop valve by the interaction between the first and second valve elements when the flow stop valve is in the closed position and the first port is in fluidic communication with the fluid in the downhole tubular and below the flow stop valve when the flow stop valve is in the open position.

10. The method of claim 8, wherein the method further comprises permitting the second valve element to be movably disposed with respect to the first valve element.

11. The method of claim 10, wherein the method further comprises biasing the second valve element towards the closed position by virtue of another resilient member.

12. The method of claim 8, wherein the method further comprises providing a third valve element disposed so as to limit the movement of the second valve element.

13. The method of claim 12, wherein the method further comprises:

permitting the first and second valve elements to move together under action of the fluid above the flow stop valve and in the downhole tubular until the second valve element abuts the third valve element; and permitting the first and second valve elements to move apart upon further movement of the first valve element so as to allow fluid to flow between the first and second valve elements, thereby permitting flow through the flow stop valve and placing the flow stop valve in an open position.

14. The method of claim 8, wherein the method further comprises drilling in the dual fluid density system with the flow stop valve disposed in a drill string.

15. The method of claim 8, wherein the method further comprises cementing in the dual fluid density system with the flow stop valve connected to a casing section to be cemented into place.

16. A flow stop valve for a downhole tubular, comprising:

a housing defining a first chamber;

a first valve element disposed in the housing and defining a central flow passage, a first port, and a second port, the first and second ports being in fluid communication with the first chamber, wherein the first valve element is movable by exposure to a pressure difference between fluid outside the downhole tubular and inside the downhole tubular at the flow stop valve, or between fluid above and below the flow stop valve inside the downhole tubular; and a second valve element disposed in the housing and engageable with the first valve element to block the central flow passage, wherein, when the flow stop valve is in an open position, the second valve element is at least partially spaced apart from the first valve element such that a high velocity, low pressure flow region is defined in a gap between the first and second valve elements, and a first pressure of the high velocity, low pressure flow region is communicated to the first chamber via the first port, and wherein, when the flow stop valve is in a closed position, the second valve element engages the first valve element and blocks the central flow passage, and a second pressure is communicated from a point within the housing and uphole of the first valve element, at least through the second port, to the first chamber.

17. The flow stop valve of claim 16, wherein the first valve element further defines a first passage extending from the first port, and a second passage extending from the second port, the first and second passages being in fluid communication with the first chamber.

18. The flow stop valve of claim 17, wherein the first and second passages intersect within the first valve element.

19. The flow stop valve of claim 16, wherein the first valve element comprises a valve seat that engages the second valve element when the flow stop valve is in the closed position, the first port being defined in the valve seat.

20. The flow stop valve of claim 16, further comprising a resilient member disposed in the first chamber, engaging the first valve element, and applying a biasing force thereto, the biasing force being oriented toward the second valve element such that the biasing force causes the flow stop valve to actuate to the closed position when the pressure difference is below a threshold value.

21. The flow stop valve of claim 16, wherein the first valve element further comprises:

a sleeve that is slidable relative to the housing, the sleeve comprising a valve seat that engages the second valve element when the flow stop valve is in the closed position; and a tubular section disposed at least partially radially within the sleeve, wherein the tubular section is prevented from sliding with the slidable sleeve, and wherein the tubular section comprises a contact portion that disengages the second valve element from the valve seat when the sleeve slides downhole relative to the tubular section, the central flow passage being at least partially defined within the tubular section.

22. The flow stop valve of claim 21, wherein first and second ports are disposed on a first side of the sleeve, and the first chamber is disposed on a second side of the sleeve.

23. The flow stop valve of claim 21, wherein the first chamber is positioned radially between the housing and the tubular section.

24. The flow stop valve of claim 16, wherein, when the flow stop valve is in the open position, the second pressure is communicated to the first chamber via at least the second port.

25. A method for dual gradient drilling, comprising:

deploying a tubular string comprising a flow stop valve in a closed position into a well, the flow stop valve comprising:

a housing defining a first chamber;

a first valve element disposed in the housing and defining a central flow passage, a first port, and a second port, the first and second ports being in fluid communication with the first chamber; and a second valve element disposed in the housing and engageable with the first valve element to block the central flow passage, wherein, when the flow stop valve is in the closed position, the second valve element engages the first valve element and blocks the central flow passage, and a pressure is communicated from uphole of the first valve element and in the housing, through the second port, to the first chamber; and after at least partially deploying the tubular string, increasing a fluid pressure in the tubular string, such that the flow stop valve is actuated to an open position, wherein, when the flow stop valve is in the open position, the second valve element is at least partially spaced apart from the first valve element such that a high velocity, low pressure flow region is defined between the first and second valve elements, and a pressure of the high velocity, low pressure flow region is communicated to the first chamber via the first port.

26. The method of claim 25, wherein deploying the tubular string comprising the flow stop valve into the well causes the first and second valve elements to move relative to the housing in response to a hydrostatic pressure increase, without the first and second valve elements separating, and wherein increasing the fluid pressure causes the second valve element to be disengaged from the first valve element, to open the flow stop valve.

27. The method of claim 25, wherein, when the flow stop valve is in the open position, the pressure is communicated from uphole of the first valve element and in the housing, at least through the second port, and to the first chamber.

* * * * *